US006899656B2

(12) United States Patent
Johnston et al.

(10) Patent No.: US 6,899,656 B2
(45) Date of Patent: May 31, 2005

(54) EXERCISE RECORDING AND TRAINING APPARATUS

(75) Inventors: Allen Kent Johnston, Kirkland, WA (US); Eike Mueller, Hardy, AR (US); Darren Krein, Kirkland, WA (US)

(73) Assignee: Genesis Alliance, L.L.C., Waco, TX (US)

( * ) Notice: Subject to any disclaimer, the term of this patent is extended or adjusted under 35 U.S.C. 154(b) by 42 days.

(21) Appl. No.: 10/684,958

(22) Filed: Oct. 14, 2003

(65) Prior Publication Data

US 2004/0082439 A1 Apr. 29, 2004

Related U.S. Application Data

(62) Division of application No. 10/032,993, filed on Oct. 23, 2001, now Pat. No. 6,659,913.

(60) Provisional application No. 60/275,153, filed on Mar. 12, 2001, and provisional application No. 60/260,552, filed on Jan. 8, 2001.

(51) Int. Cl.[7] ..... A63B 21/00

(52) U.S. Cl. ..... 482/8; 482/1; 482/900

(58) Field of Search ..... 482/1–9, 51, 900–902; 700/183; 318/568.11; 73/379.01–379.03, 379.08, 379.09

(56) References Cited

U.S. PATENT DOCUMENTS 4,891,764 A * 1/1990 McIntosh ..... 700/183
6,632,159 B1 * 10/2003 Slattery ..... 482/94
6,801,008 B1 * 10/2004 Jacobus et al. ..... 318/568.11

* cited by examiner

*Primary Examiner*—Glenn E. Richman
(74) *Attorney, Agent, or Firm*—John A. Thomas

(57) ABSTRACT

A method for sports training allows an athlete to move an exercise bar connected between congruent trusses freely in two dimensions. The resistance the bar offers to the movements of the user is programmable and may be varied according to predetermined parameters and also as a predetermined function of measured parameters. The parameters of the exercise may also be recorded.

21 Claims, 19 Drawing Sheets

Fig. 23

SELECT TRAINING PROGRAM

1- UPPER STRENGTH ☐
2- LOWER STRENGTH ☐
3- FLEXIBILITY ☒
4- STARTING STRENGTH ☐
5- ENDURANCE ☐
6- ABSOLUTE POWER ☐
7- ACCELERATION ☐
8- AGILITY ☐
9- JUMPS ☐

Fig. 24

SELECT LOAD PROGRAM

1- CONSTANT LOAD ☐
2- VARIABLE LOAD ☒
3- VAR. LOAD AS f(SPEED) ☐
4- ABSOLUTE STRENGTH ☐

Fig. 25

CONSTANT LOAD

ENTER VALUE ☐ lbs

Fig. 26

VARIABLE LOAD

| | | | |
|---|---|---|---|
| 1- | STARTING | [ ] | lbs |
| 2- | 10% SETTING | [ ] | lbs |
| 3- | 20% SETTING | [ ] | lbs |
| 4- | 40% SETTING | [ ] | lbs |
| 5- | 60% SETTING | [ ] | lbs |
| 6- | 80% SETTING | [ ] | lbs |
| 7- | 90% SETTING | [ ] | lbs |
| 8- | ENDING | [ ] | lbs |
| 9- | CENTER / ALT | [ ] | lbs |

Fig. 27

VARIABLE LOAD AS f(SPEED)

| | | | |
|---|---|---|---|
| 1- | STARTING | [ ] | lbs |
| 2- | ENDING | [ ] | lbs |
| 3- | SPEED SETTING | | |
| 3.1- | LOW | [ ] | % UP |
| 3.2- | MEDIUM | [ ] | % UP |
| 3.3- | HIGH | [ ] | % UP |

Fig. 28

SELECT BAR POSITION

| | | |
|---|---|---|
| 1- | UPPER | [ ] |
| 2- | CENTER | [ ] |
| 3- | LOWER | [ ] |
| 4- | AUTOMATIC DETECT | [X] |

EXERCISE RECORDING AND TRAINING APPARATUS

CLAIM FOR PRIORITY

This application is a division of U.S. application Ser. No. 10/032,993, filed Oct. 23, 2001 now U.S. Pat. No. 6,659,913, which claims the benefit of U.S. provisional application No. 60/260,552, filed Jan. 8, 2001, and U.S. provisional application No. 60/275,153, filed Mar. 12, 2001.

INCORPORATION BY REFERENCE

This application is a division of our prior-filed application of the same title, filed Oct. 23, 2001, under Ser. No. 10/032,993, which application is incorporated into this divisional application by reference.

FIELD OF THE INVENTION

This application relates generally to sport training equipment, and more specifically, to training equipment that allows an athlete to move an exercise bar freely in two dimensions. In particular, this application describes sports training equipment that can also be used for performance testing in various training regimes and body zones of an athlete because the resistance to the movements of an athlete is variable according to predetermined programs.

BACKGROUND OF THE INVENTION

Existing sport training equipment is suitable for training in specific areas. Typically, sports training equipment is dedicated to particular exercises, such as leg exercises by squats, or chest exercises by pushing against resistance with the arms. Common to all the equipment used today (with exception of equipment using cables) is that the user moves a bar or handle in either a straight line or along the perimeter of a circle.

Different exercises need different degrees of freedom in the movement. Take as an example an exercise like weight lifting. The path of movement of the athlete's hands is not necessarily along a linear or circular path.

For an exercise such as an arm curl, a machine with a one dimensional movement of the bar would not be appropriate. The invention described in this application allows the athlete executing arm curls to move the bar along the same path as when he uses free bar bells.

It is important, especially in professional sports training, that an athlete's strength and range of motion be capable of reliable measurement, so that his performance may be compared with his past performance or the performance of others. This implies that the load or resistance against which the athlete is working be variable, so that all variables but one can be controlled and measured. These variables include displacement of the exercise bar, speed of movement, acceleration, and the force exerted by the athlete. The power generated and the energy expended during the exercise may also be relevant to particular sports training programs.

There is thus a need for an exercise apparatus that allows free movement of the athlete's body during an exercise, allows for the execution of different exercises without substantial changes in the configuration of the apparatus, and which allows for valid and reliable measurement of the parameters of the exercise.

SUMMARY OF THE INVENTION

Am apparatus suitable for the practice of the methods disclosed in this application comprises two substantially parallel pantograph trusses. Each pantograph truss further comprises a plurality of beams and a plurality of pivots; the beams being moveably connected at the pivots. At least two congruent pivots have a central bore for receiving an exercise bar through the bore.

There is at least one exercise bar moveably mounted between congruent pivot of the pantograph trusses, for transmitting to the pantograph trusses a force applied by a user to the exercise bar. At least one stabilizer bar is mounted between two other congruent pivots of the pantograph trusses.

The apparatus has two substantially parallel rails; each of the rails has traveling thereon linear bearings. The linear bearings moveably support the pantograph trusses.

The apparatus preferably has at least one vertical actuator connected between a two vertically opposing pivots of the pantograph truss; or, a vertical actuator connected between a pivot and the corresponding rail, and at least one horizontal actuator, connected between two pivots of a pantograph truss. The horizontal actuator may be replaced by a spring system that keeps the pantograph trusses centered between the two ends of each rail.

The apparatus has a load control system, such that the vertical and horizontal actuators are responsive to the active load control system. There is a means for measuring the displacement of the exercise bar; the means for measuring the displacement of the exercise bar being operatively connected to the load control system. The load control system includes a programmable computer, which is programmed to accept inputs from displacement and pressure transducers attached to the pantograph trusses and the actuators. The programmed computer computes a load program according to values entered by a user and controls valves connected to the actuators to maintain the speed and displacement of the exercise bar within the pre-determined limits. In different embodiments, the actuators may be hydraulic or pneumatic, or some combination of hydraulic or pneumatic actuators, or electric motors.

The reader should note, however, that the methods disclosed are not limited to the specific apparatus just described, but may be practiced on any exercise apparatus having actuators for moving its exercise bar and sensors for measuring the displacement of the bar.

In a typical embodiment the method may comprise programming the computer to generate actuator signals for a predetermined exercise activity, and then generating displacement signals from the means for measuring the displacement over time of the exercise bar. The next step is to transmit the displacement signals to the computer, and calculating, in the computer, the speed and acceleration of the exercise bar, calculating one or more actuator signals sufficient to maintain the speed, displacement, or force parameters for the predetermined exercise activity, and then transmitting the actuator signal to counter-force valves, so that the actuators are commanded to move the exercise bar according to the predetermined exercise activity.

BRIEF DESCRIPTION OF THE DRAWINGS

FIG. 2 shows side views of a typical pantograph truss, showing the truss moveably attached to a rail.

FIGS. 23 through 28 depict typical data-entry screens for setting the parameters of the preferred embodiment.

DESCRIPTION OF THE PREFERRED EMBODIMENT

Construction of the Preferred Embodiment of the Exercise Apparatus

Figure 1:
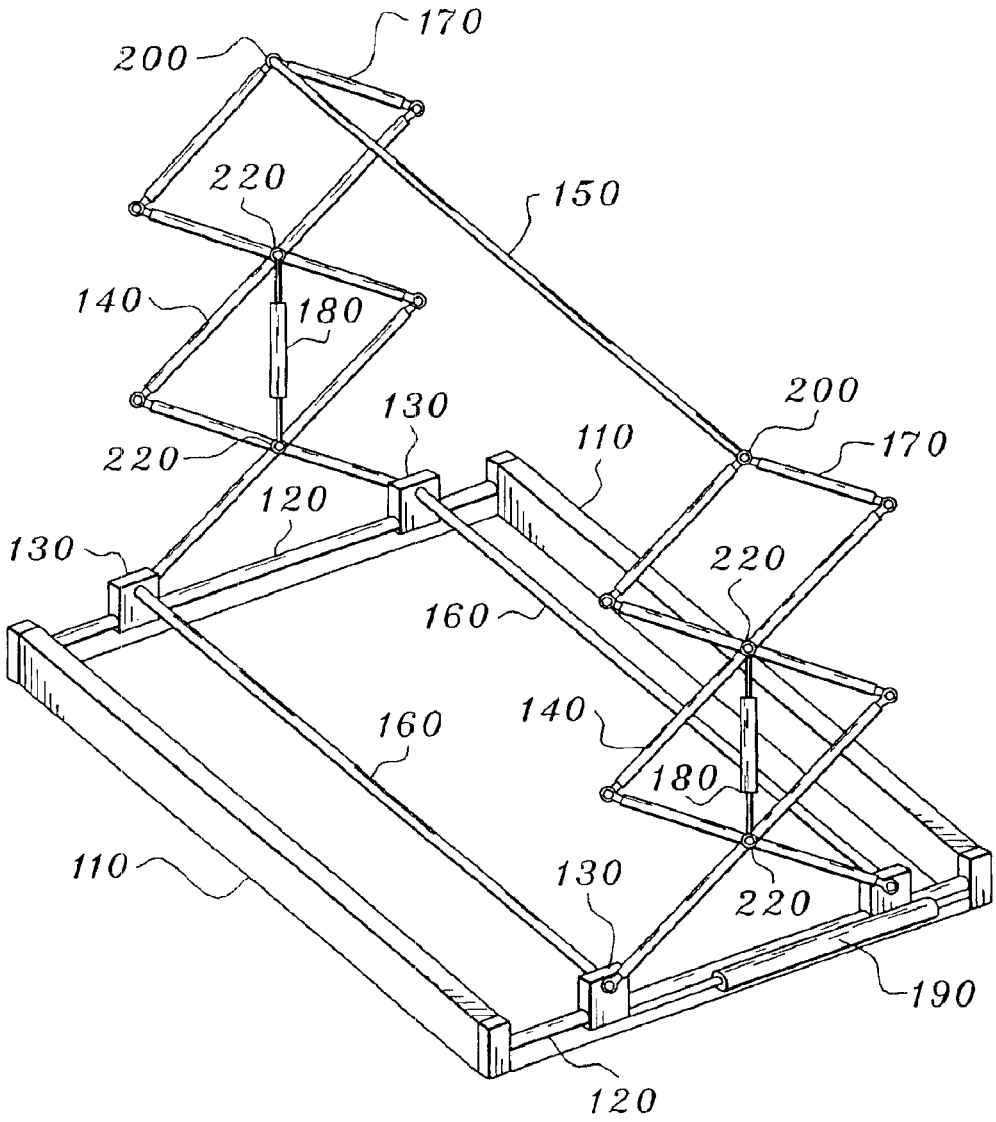
FIG. 1 is a perspective drawing of the preferred embodiment of the invention, showing two pantograph trusses connected by bars.

The preferred embodiment is shown in FIG. 1. Two substantially parallel pantograph trusses (100) are slideably mounted on rails (120). The trusses (100) are connected by a exercise bar (150) and one or more stabilizer bars (160). A frame (110) supports the entire apparatus and the rails (120). The width of the frame (110) determines the space between the two pantograph trusses (100). In use, an athlete exerts force against the exercise bar (150), which is connected to a pivot point (200) on each pantograph truss (100). It is desirable that the pantograph trusses (100) be substantially congruent to each other.

Figure 2A:
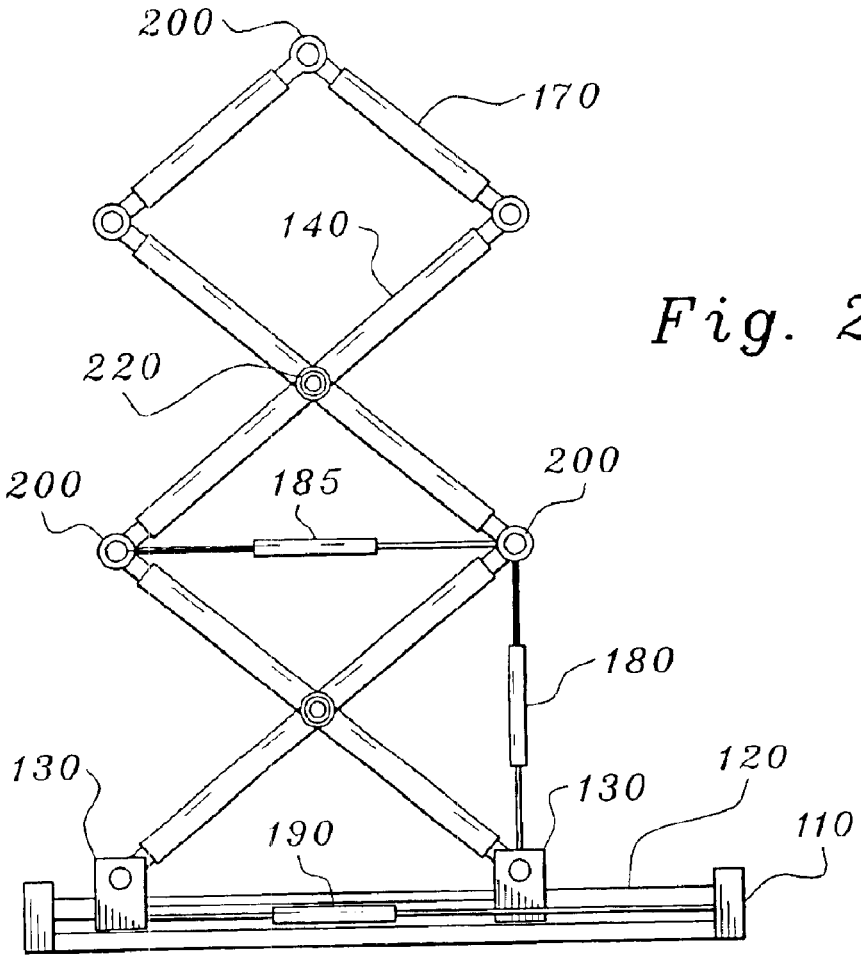
In FIG. 2A, the truss is expanded vertically.
Figure 2B:
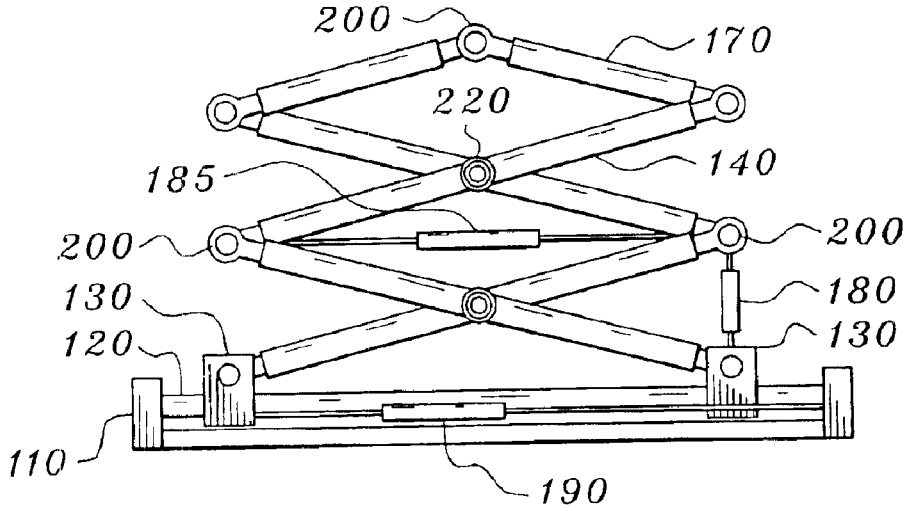
in FIG. 2B, the truss is compressed vertically.

Each pantograph truss (100) includes full beams (140) and half beams (170). Each beam (140, 170) has two pivots (200) which allow it to be rotatably connected to another beam (140, 170), as described in more detail below. FIGS. 2A and 2B show side views of the pantograph trusses (100). Each full beam (140) also has a central pivot hole (220) for rotatable connection at its mid-point with another full beam (140). Each pantograph truss (100) is connected to linear bearings (130) which are supported by a rail (120) in sliding contact. The pantograph truss (100) may thus expand and contract as shown in FIGS. 2A and 2B. FIGS. 1 and 2 show a vertical load control means (180) and a horizontal load control means (190) connected, respectively, between a pivot (220) and the frame (110) and between two pivots (200). Different combinations of load control means (180, 190) are shown in FIGS. 1 and 2, as explained in more detail below.

The reader will see that the modular construction of the preferred embodiment allows construction of many different configurations of the pantograph trusses (100) and the exercise bar (150). For example, a system of beams (140, 170) may be constructed differently for tall or short athletes, or for different exercises. Another possible embodiment consists only of half beams (170) attached directly to the linear bearings (130). This configuration may be used to support a jump plate to measure the input force into the ground during jump exercises.

Figure 3A:
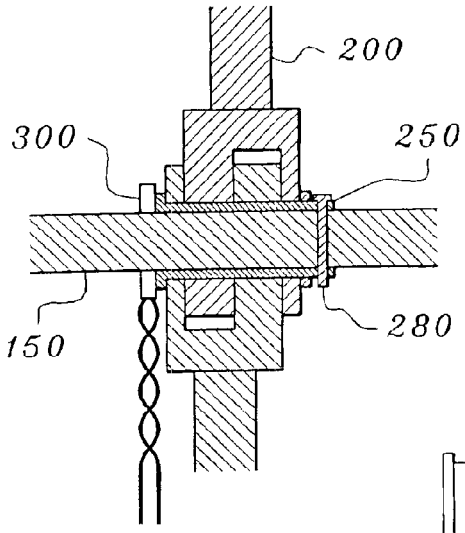
FIGS. 3A through 3E shows details of the pivots of the pantograph truss.
Figure 3B:
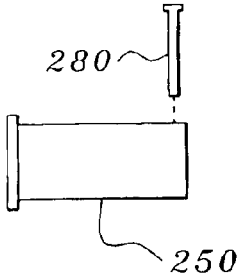
Figure 3C:
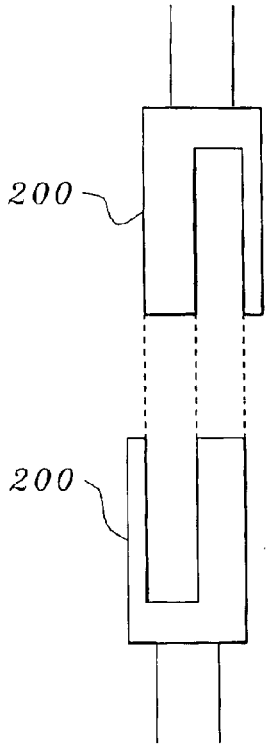
Figure 3D:
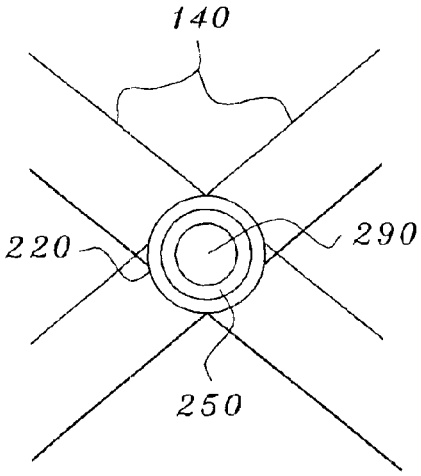
Figure 3E:
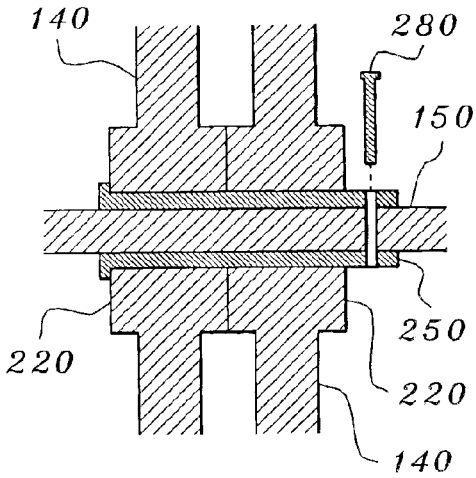

FIG. 3A is a cross section of the pivots (200) at the ends of the beams (140, 170). In the preferred embodiment, the pivots are joined with a bushing (250). The bushing (250) may be fastened in place by a pin (280), or other releasable fastening means. The bushing (250) has a bore (290) to allow passage of an exercise bar (150) or a stabilizer bar (160). FIG. 3C shows the interlocking pivots (200). FIG. 3C shows the preferred bushing (250) and pin (280) means of connecting the pivots (200) to each other and also allowing passage of an exercise bar (150) or stabilizer bar (160) FIGS. 3D and 3E depict the central pivot (220) between the centers of two full beams (140). This pivot also has a bushing (250) having a bore (290). The reader will see that other means may be used to make rotatable joints between the beams (140, 170), and the invention is thus not limited to the embodiment shown. FIG. 3A also shows an angle transducer (300) connected to the pivots (200) forming the connection. The angle transducer (300) is connected to measure and transmit the angular relationship between the two beams (140, 170) connected at a pivot (200, 220). The angle transducer (300) may also be connected at a central pivot (220). The angle transducer (300) may be a conventional potentiometer or an optical encoder. This angle is used as described below to calculate the position of the pantograph truss (100) and thus the exercise bar (150) as it is moved by an athlete.

Some sort of load control means is necessary to offer resistance to the athlete using the apparatus. This load control means may, in general, be passive or active. FIGS. 1 and 2A and 2B show load control means (180 and 190) connected to the pantograph trusses (100) in different possible ways. In general, each pantograph truss (100) will have a horizontal load control means (190) and a vertical load control means (180) moveably connected to it. In FIG. 1, the preferred embodiment, the horizontal load control means (190) is connected between the frame (110) and a linear bearing (130) where a beam pivot (200) is connected. In general, it is satisfactory if the horizontal load control means (190) is a spring adjusted to keep the linear bearings (130) centered on the rails (120). In FIG. 1, the vertical load control means is connected between two center pivots (220). In FIGS. 2A and 2B, the vertical load control means (180) is connected between a linear bearing (130) and a vertically-disposed pivot (200), and a horizontally-disposed vertical load control means (185) is connected between two horizontally opposed pivots (200). The function of the load control means (180, 190) is discussed below. FIG. 1 shows the preferred embodiment.

Figure 2C:
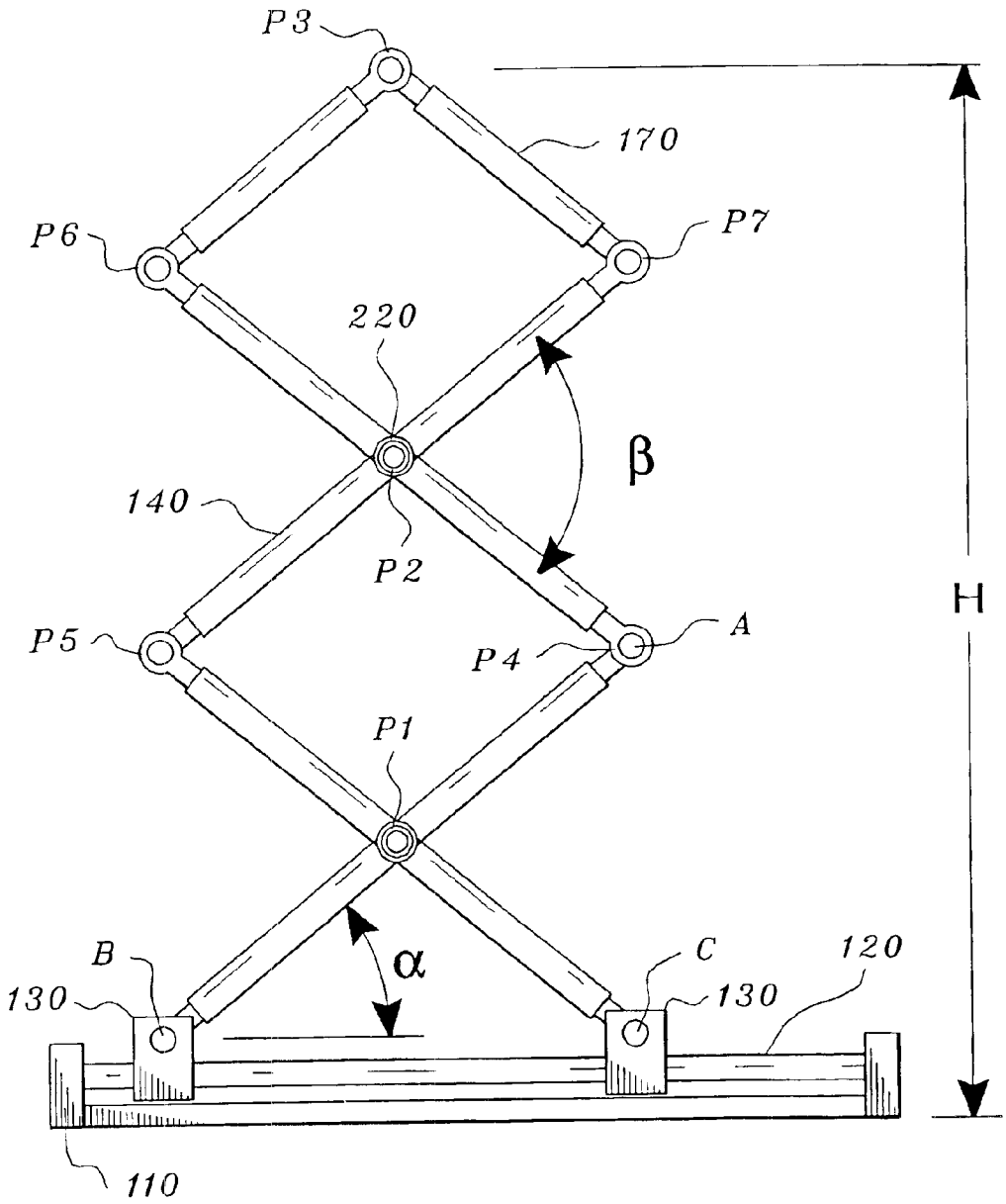
FIG. 2C shows the angular relationships between the beams of the trusses, which relationships are used to measure displacement of a waypoint on the trusses.

We now describe how the size and angular relationship of the beams (140, 170) determine the range of motion of the apparatus. As shown in FIG. 2C, points A, B, and C define an angle, $\alpha$. Since the full beams (140) and the half beams (170) are rigid, and rigidly connected at their ends to the pivots (200), the length of the beams (140, 170) and the angle $\alpha$ entirely determine the shape and size of the pantograph trusses (100).

For example, let the length of the full beam (140) be 112 cm and the length of the half beam (170) be 56 cm. Then the height of the pantograph truss (100) of four full beams (140) and two half beams (170) shown in FIG. 2C is:

For $\alpha$=5.0 degrees, $$H=\sin(5.0)*(2L+L/2)=24.4 \text{ cm, and}$$

for $\alpha$=65.0 degrees, $$H=\sin(65)*(2L+L/2)=253 \text{ cm.}$$

Thus the total range of height of the pantograph truss (100) is 228.6 cm as $\alpha$ varies from 5 degrees.

The movement of the two linear bearings (130) riding on the rail can be calculated similarly:
For $\alpha$=5 degrees $$\text{Distance } B\text{–}C=\cos(5)*L=111.6 \text{ cm, and}$$

for $\alpha$=65 degrees $$\text{Distance } B\text{–}C=\cos(65)*L=47.3 \text{ cm.}$$

Thus the linear bearings (130) supporting the pantograph truss (100) move toward each other a total of 64.3 cm as $\alpha$ varies from 5 degrees to 65 degrees. The length of the rails (120) must obviously be great enough to accommodate this movement.

The reader will understand that the dimensions given above are illustrative only. The invention may be embodied in an apparatus having trusses with differently-sized beams. The angles given for $\alpha$ would be typical, but may be more or less in any particular embodiment of the invention. FIG. 2C also shows an angle $\beta$ measured between two full beams (140). Angle $\beta$ is equal to $2\alpha$, and thus the same parameters of the apparatus may be calculated from measurement of angle $\beta$, using $\alpha=\frac{1}{2}\beta$ in the equations above.

In the preferred embodiment, either angle $\alpha$ or angle $\beta$ is measured by a transducer (300) located at the appropriate pivot (200, 220). With this angle known, along with the lengths of the beams (140, 170), it is possible to calculate the displacement over time of any point on a pantograph truss (100), in particular the pivot (200) through which the exercise bar (150) is inserted. As described below, other parameters, such as speed generated, force exerted and work expended by the athlete may be calculated and recorded. Using the relationships set out above, a user can easily determine the number of full beams (140) and half beams (170) and their lengths he will need for a particular exercise configuration.

The Load Control Means

A passive load control means introduces a certain fixed load into the exercise apparatus. Generally, such a passive system will compensate for gravity. A typical passive load means will be springs acting as the vertical load control means (180) and the horizontal load control means (180). For an athlete, such a passively-controlled system will simulate the feel of lifting barbells.

Figure 4:
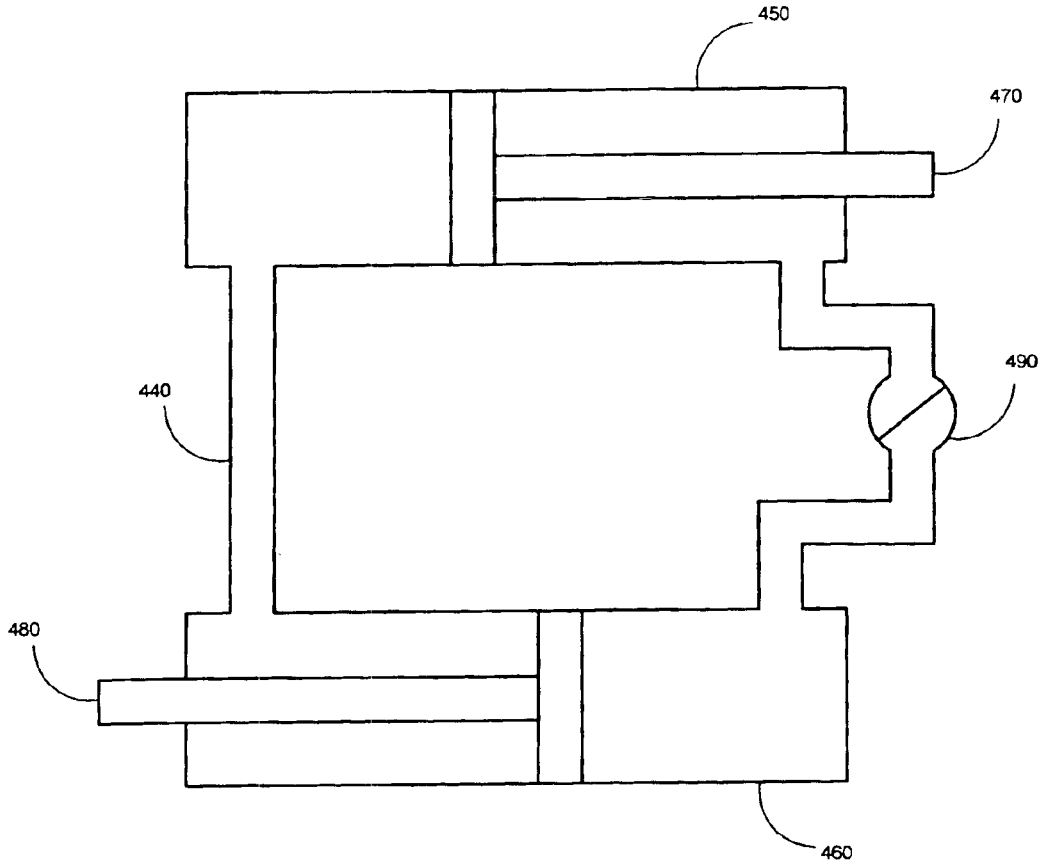
FIG. 4 shows a schematic view of a typical load control means for a passive embodiment of the invention.

A hydraulic passive control means is also possible, as shown in FIG. 4. A first passive hydraulic cylinder (450) is connected to a second passive hydraulic cylinder (460), by a fluid line (440) between the top reservoirs of the cylinders (450, 460) and a fluid line with a valve (490). The degree of opening of the valve (490) thus controls the rate at which fluid can flow through the cylinder system, when the cylinder actuator rods (470, 480) are connected between points on an exercise apparatus and are moving in opposite directions. The vertical load control means (180) and horizontal load control means (190) shown in FIGS. 2A and 2B could be the springs or the hydraulic passive control mechanism just discussed.

Figure 16:
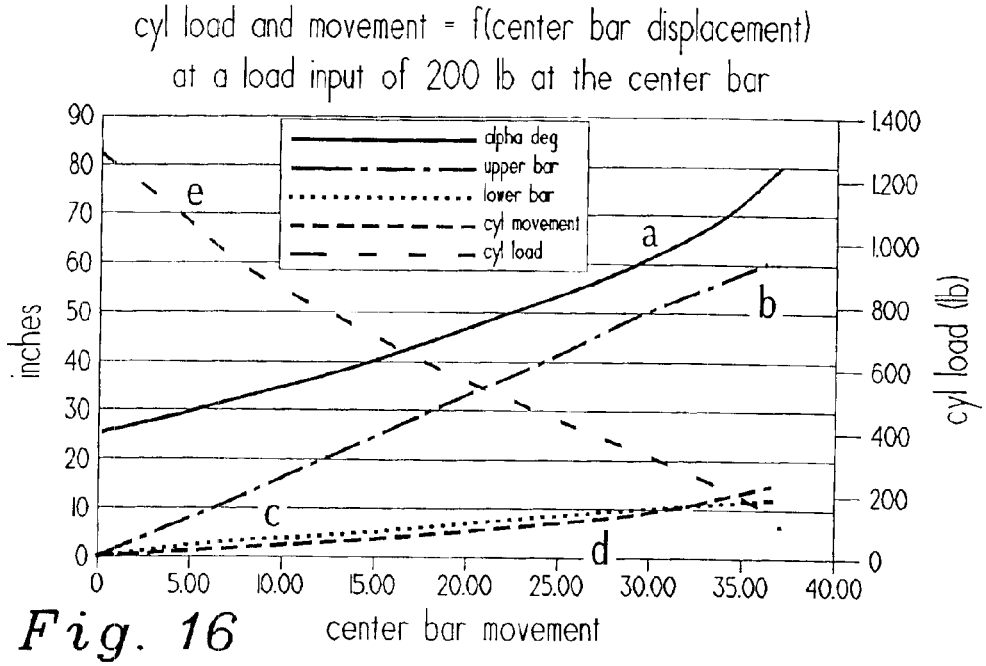

The examples shown so far relate to the horizontal attachment of the passive or active load control means. The correlation between the movement of the horizontal load control cylinder (185) and the beams (140, 170) is shown in FIG. 16. It shows over the displacement of the center bar location the following values: angle $\alpha$ change (trace a); upper exercise bar (150) attachment movement (trace b); control cylinder piston movement (trace c); lower exercise bar (150) attachment movement (trace d); and load on the horizontal cylinder at a constant 200 lb (889.6 Newtons) force input from the athlete at the center bar (trace e).

Figure 20:
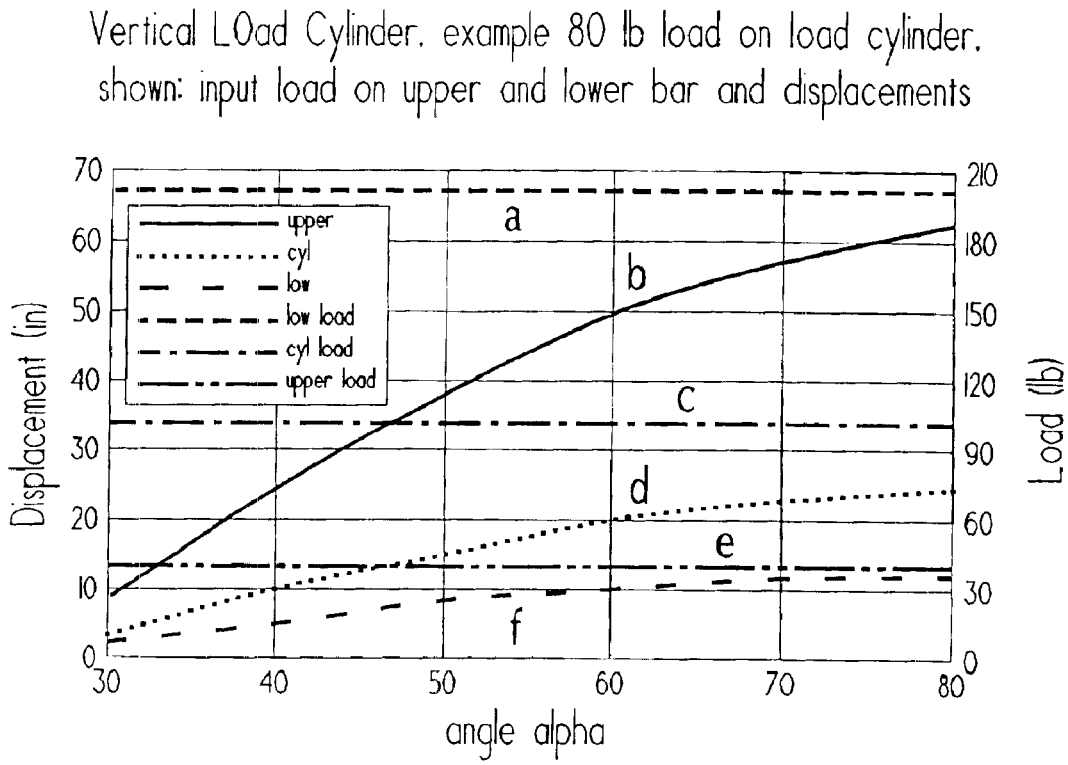

These curves can be explained by the changing leverage when the exercise bars are moved. When the load control means (180) is mounted vertically between any two points, e.g. between points A–C of FIG. 2C, the same loads on the exercise bar (150) and the vertical load control means (180) will result. FIG. 20 shows the resulting load curves. It shows the constant load (trace a) over displacement of 200 pounds (80 lb×5/2) on the lower exercise bar (150) attachment (trace a) or 48 pounds (80 lb×3/5) on the upper exercise bar (150) attachment (trace e) or 100 pounds (80 lb×5/4) at the load control means (180) attachment point A (trace d). The displacement curves of the bar attachments are shown as traces b and f. At $\alpha$ equal to 75 degrees, the upper exercise bar (150) attachment point will have traveled 152 cm (60 in) for the shown configuration and beam sizes.

Referring to FIG. 2C, we assume a load input of the value 1 lb at the top bar attachment point P3. Equilibrium will be reached when the counter force is 2 lb at positions P6 or P7, or 3 lb at the center position P2, or 4 lb at the positions P4 or P5 or 5 lb at the lower bar attachment position P1.

Figure 5:
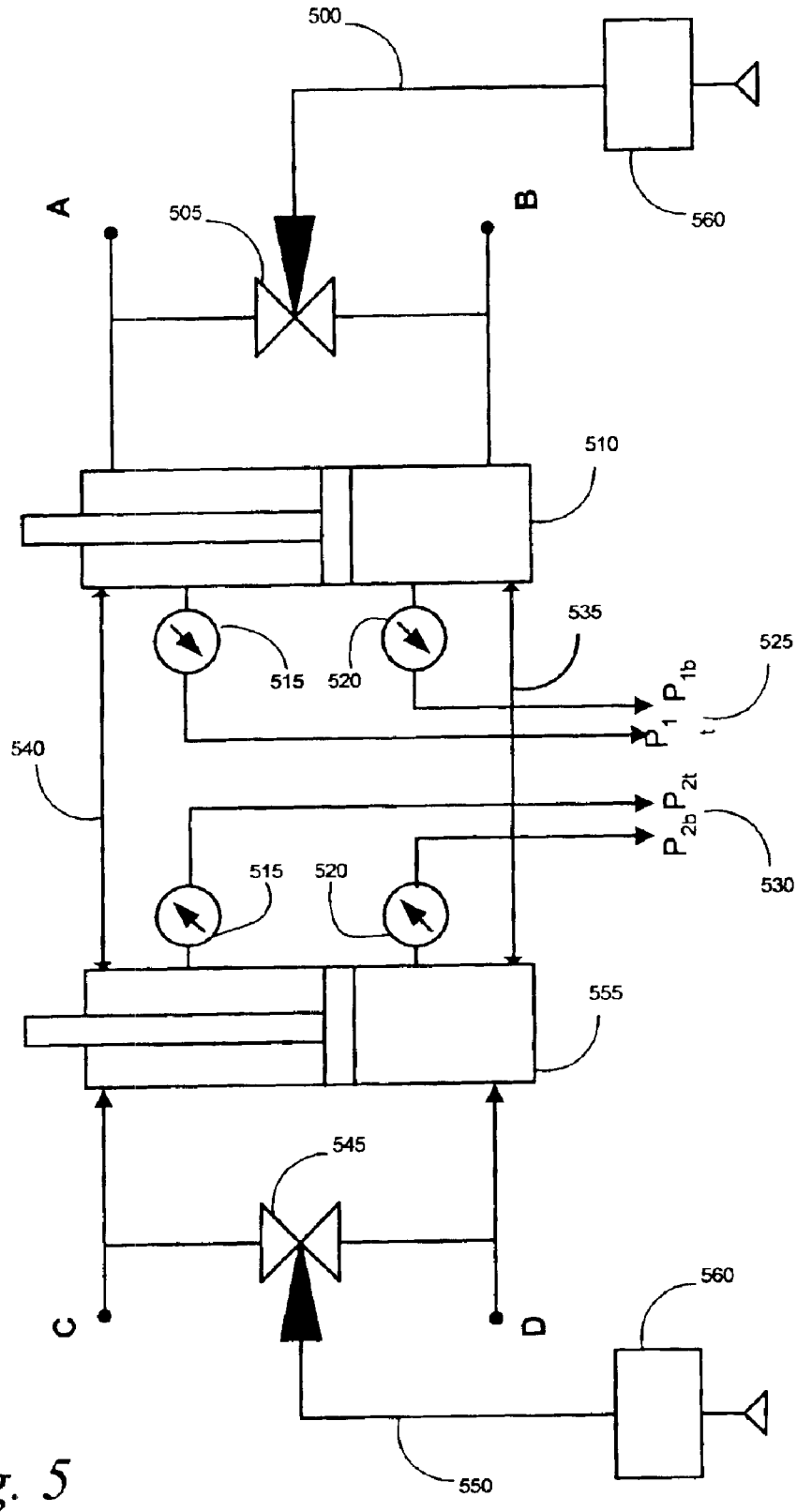
FIG. 5 is a schematic view of the fluid control system for the preferred embodiment of the invention.

FIG. 5 schematically shows a typical cylinder pair in an embodiment of the apparatus suitable for programmable passive load control. A first hydraulic cylinder 16 (510) and a second hydraulic cylinder (555) represent a pair of either vertical load control (180) means or horizontal load control means (185). The hydraulic cylinders may be the model NCDA1B400-4400-XB5 manufactured by SMC Pneumatics. The first hydraulic cylinder (510) is in parallel with a first variable load control valve (505). An appropriate valve is the model Series BB Electro-pneumatic servo manufactured by Proportion Air, Inc. The second load control valve (545) is in parallel with the second hydraulic cylinder (555). The top reservoir of the first hydraulic cylinder (510) is connected by a first line (540) with the top reservoir of the second hydraulic cylinder (555). The bottom reservoir of the first hydraulic cylinder (510) is connected by a second line (535) to the bottom reservoir of the second hydraulic cylinder (555). These lines (535, 540) equalize the pressures in the cylinders (510, 555) so that the pantograph truss (100) moves evenly.

The reader should note, however, that the load control functions may also be implemented with rotary or linear electric motors. A rotary motor, for example could be connected to the pivot (220) of a full beam (140) with its shaft connected to the intersecting full beam (140) at the same pivot (220). Or, the rails (120) and linear bearings (130) could be replaced with the motor having a linear stator and a linear "rotor" respectively. The same feedback loop described below could be easily implemented by controlling the current flowing in to motor windings instead of controlling hydraulic pressure.

The first load control valve (505) is connected by a first electrical line (500) to a switch interface controlled by the computer (600), as described below. The second load control valve (545) is also connected by a second electrical line (550) to a switch interface controlled by the computer (600) (shown in FIG. 6). By the method described below, the computer (600) generates signals that can open or close the load control valves (505, 545) in increments, thus controlling the force imposed upon the pantograph trusses (100). The top and bottom reservoirs of the first hydraulic cylinder (510) and the second hydraulic cylinder (555) have top reservoir pressure transducers (515) and bottom reservoir pressure transducers (520). A typical pressure transducer (515, 520) would be the model DSZ manufactured by Proportion Air, Inc.

The pressure transducers (515, 520) transmit their outputs to a digitizing data-collection device (560) which communicates with the data bus of the computer (600). A typical data-collection device (560) would be the model DI-194, 4-channel, 8-bit card manufactured by Dataq Instruments. The data-collection device (560) digitizes the outputs of the pressure transducers (515, 520), so the computer program can calculate a differential pressure in each load control hydraulic cylinder (510, 555). Following FIG. 5, the differential pressure in the first load control hydraulic cylinder (510) is $P_{1b}$–$P_{1t}$, and the differential pressure in the second load control hydraulic cylinder (555) is $P_{2b}$–$P_{2t}$.

The Load Control Loop

Figure 7:
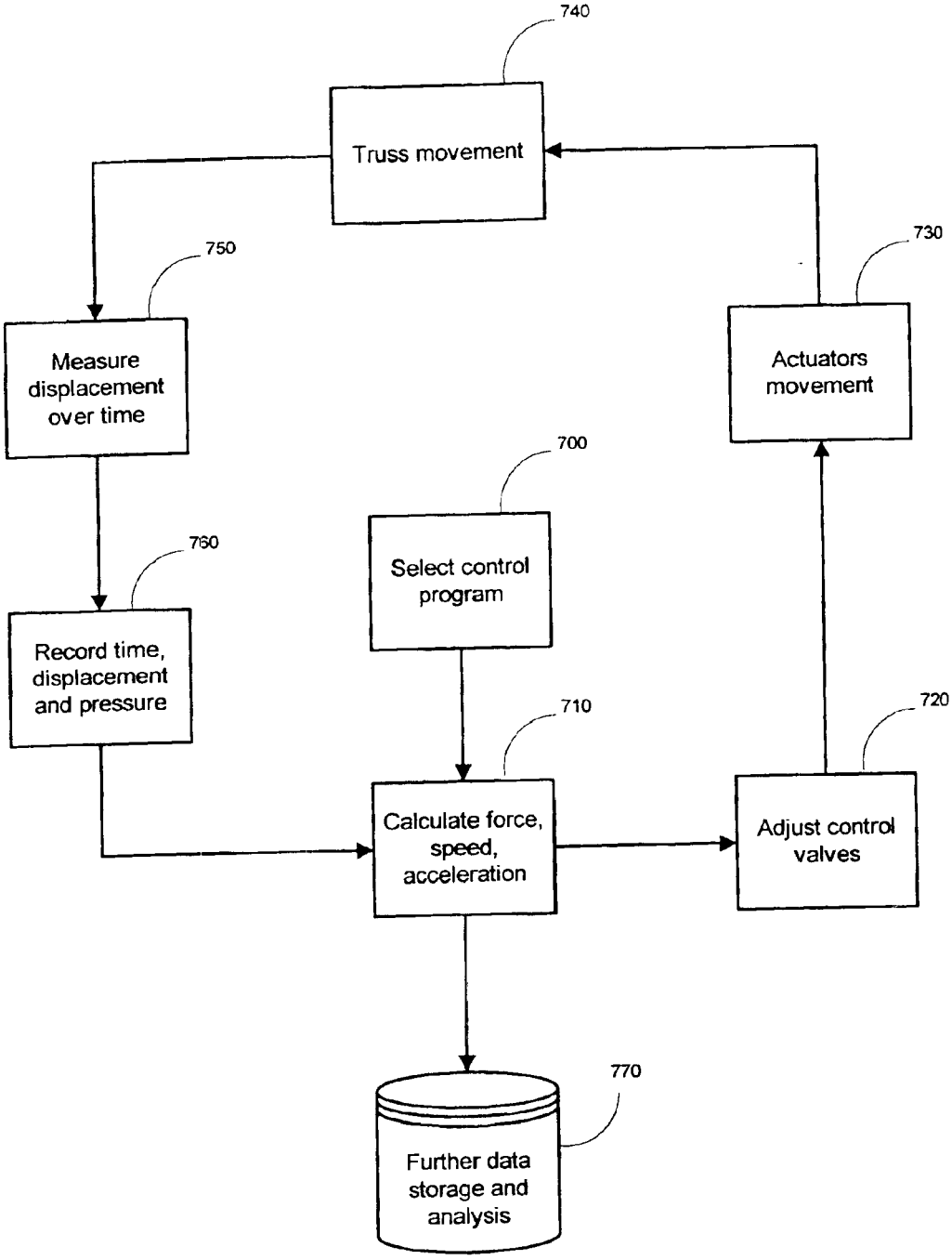
FIG. 7 is a diagram showing the overall control loop for the preferred embodiment.

The overall control loop is shown in FIG. 7. The athlete moves the exercise bar 11 (150). The displacement of the bar is measured continuously over the time. The measurement of displacement may be made by the angle transducer (300) or by a linear displacement sensor connected in parallel to one control cylinder on each side of the apparatus. Typically, a linear displacement sensor would be a linear potentiometer. By measuring the time and displacement, the speed and acceleration of the athlete's movement can be calculated by a computer (600) programmed to take the digitized data reflecting displacement and calculate from it the speed and acceleration. The computer (600) may be a general-purpose computer comprising a central-processing unit (CPU), random-access memory (RAM), a mass storage device, such as a hard disk, a communications interface, and a power supply.

Figure 8:
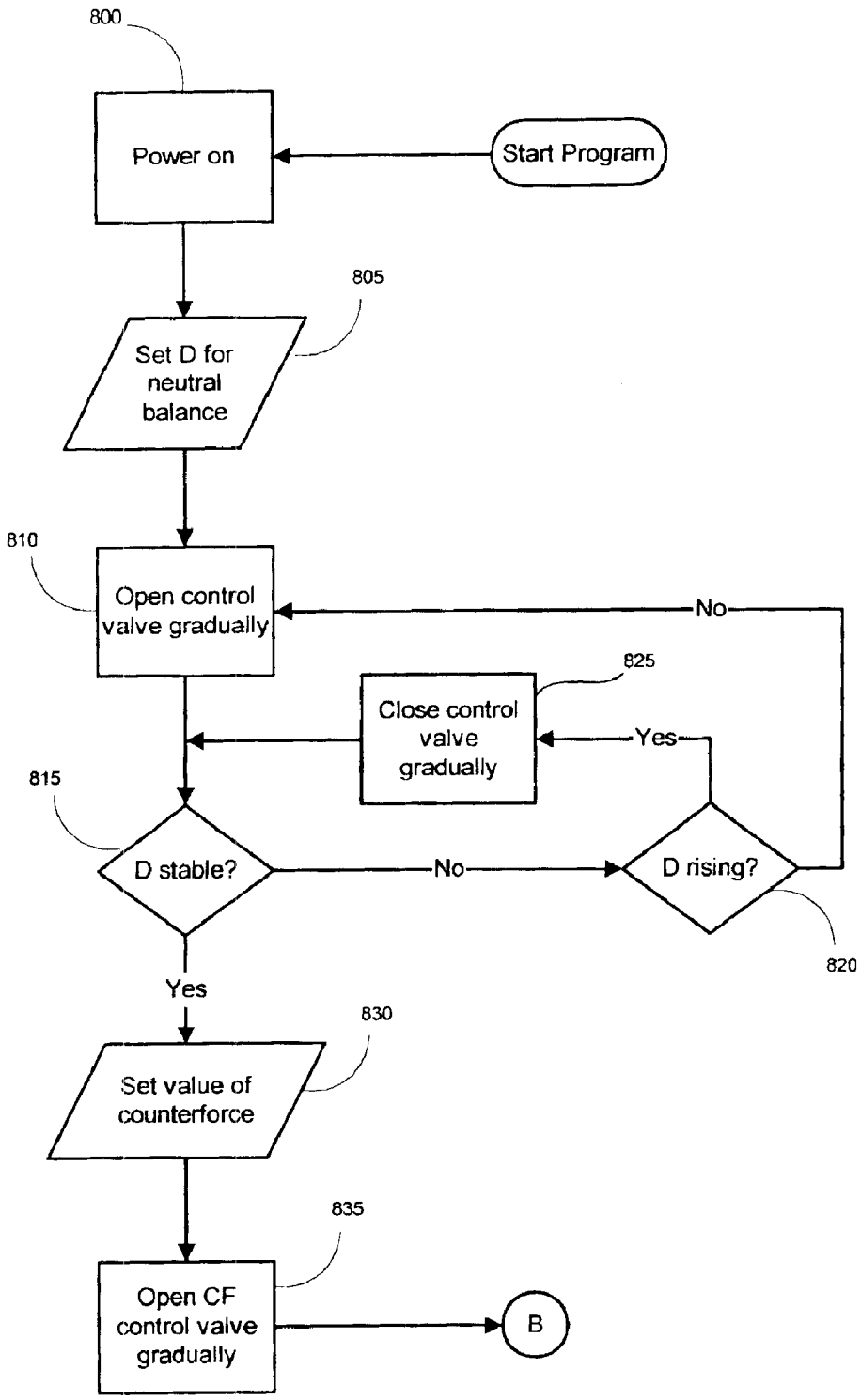
FIGS. 8, 9, and 10 are flow charts showing the preferred method for the control system.
Figure 9:
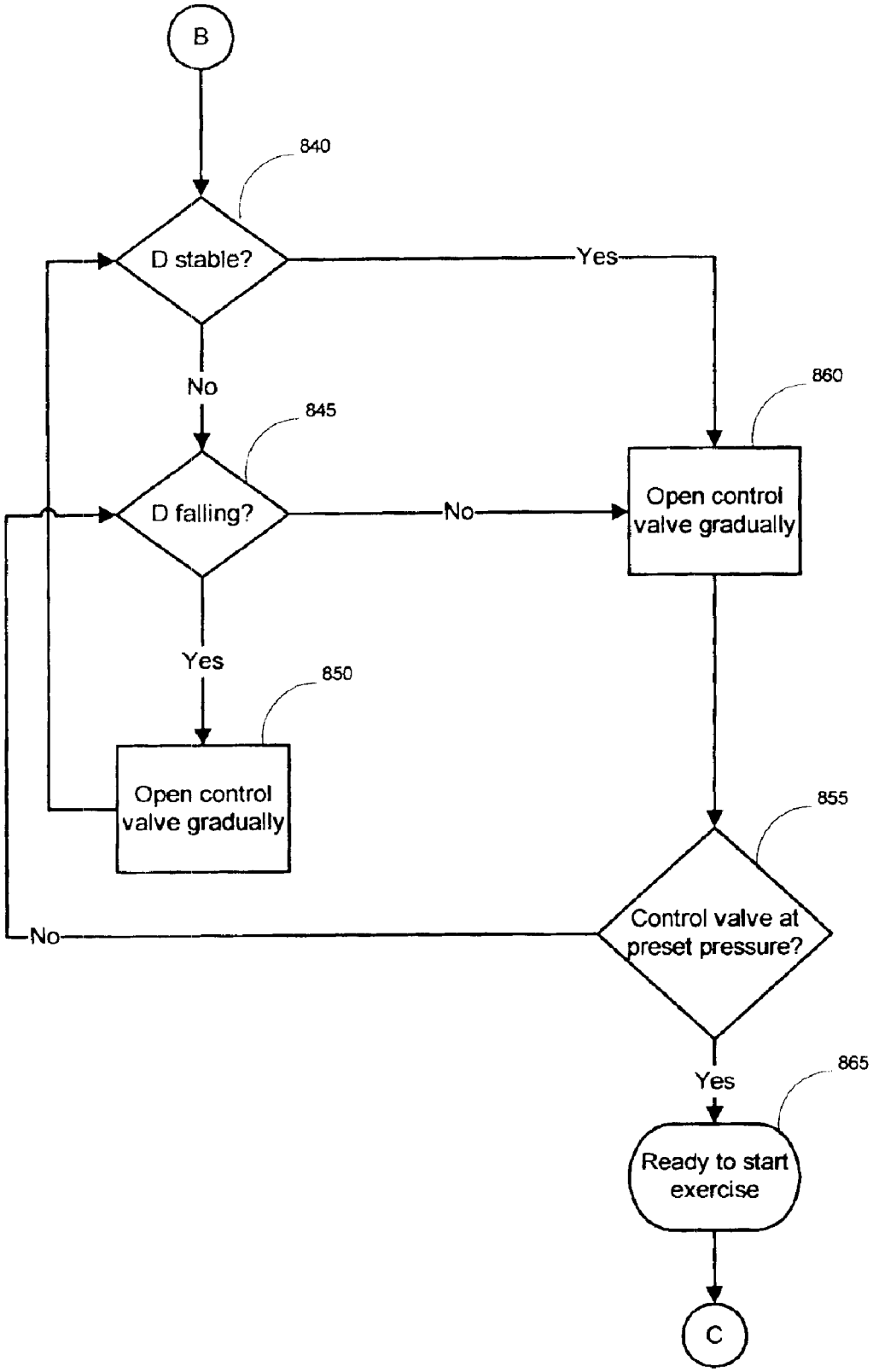
Figure 10:
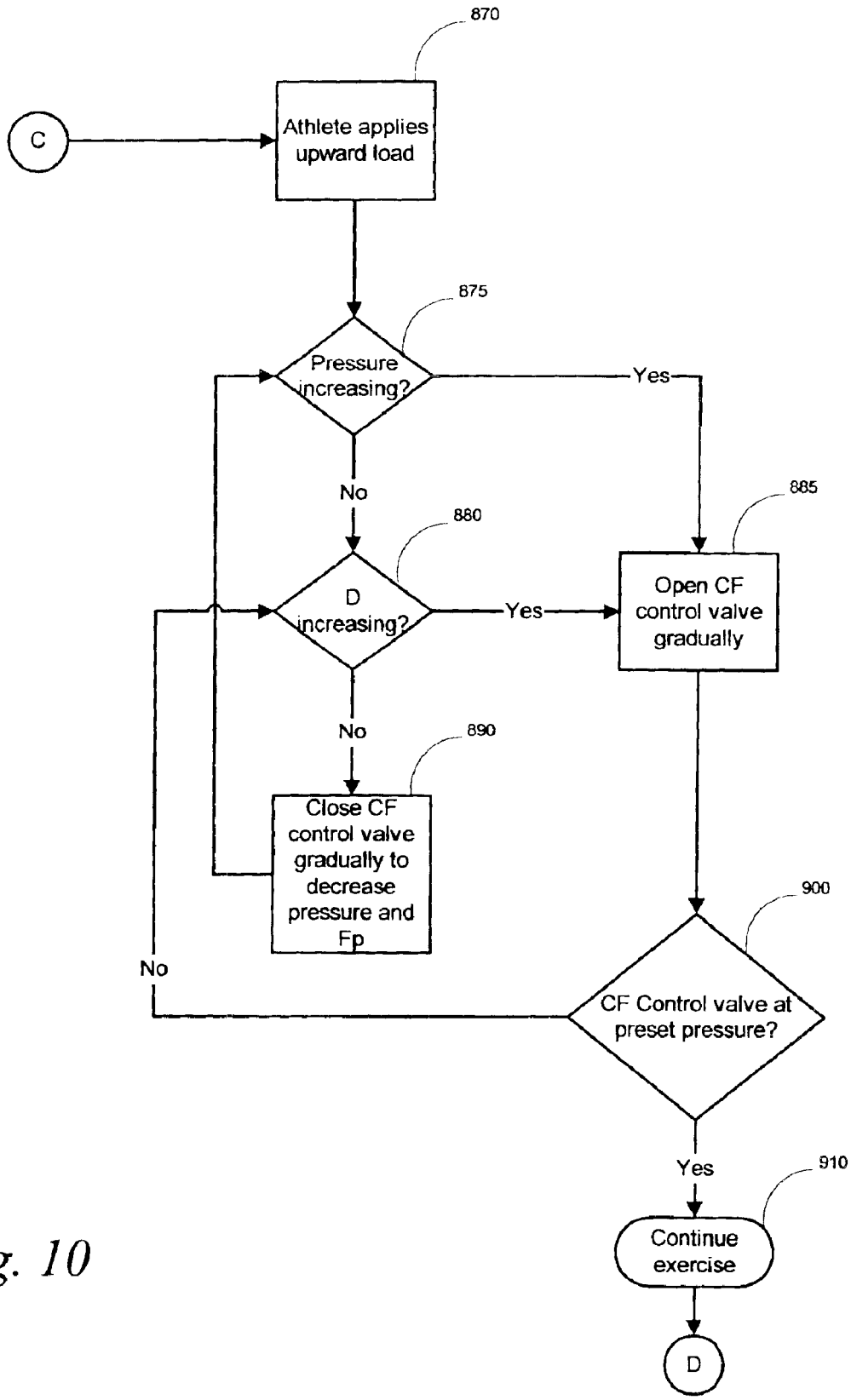

We assume the program is running on a general-purpose computer (600) programmed to carry out the steps of the control loop. Such a computer (600), and also the data-collection device (560), may be programmed in a high-level computer language such as C or BASIC. Referring to FIG. 7, at step 700 the user enters the control parameters as discussed above. The program takes these setup values and the current time, beam displacement, and cylinder pressure and calculates in step 710 a differential signal to adjust the control valves (505, 545) in step 720. This adjustment may cause movement of the load control means (180, 190) in step 730. The sum of the movement of the load control means (180, 190) and the force input by the athlete may cause a movement of the pantograph truss, (100) shown in step 740. In step 750, the displacement over time and the cylinder pressure are measured. These parameters are recorded in step 760 and passed to step 710 to again calculate their derivatives and generate a differential signal for the control valves (505, 545). The measured and 11 calculated values are stored step 770. FIGS. 8, 9, and 10, discussed below, show the control loop in more detail, particularly as applied to active loop control.

The Passive Load Control Loop

In the method, the fixed passive control means is replaced by a programmable passive load control means. The programmable passive load control method varies the resistance, or counter force that is reacting to the athlete's input force. FIGS. 1, 2A–C, and 7 show the basic idea. The horizontal load control means (190) is placed between one of the linear bearings (130) and the frame (110). Each side of the apparatus has a horizontal load control means (190). A vertical load control means (180) is connected between two center pivots (220) on each side of the pantograph truss (100), as shown in FIG. 1.

Figure 17:
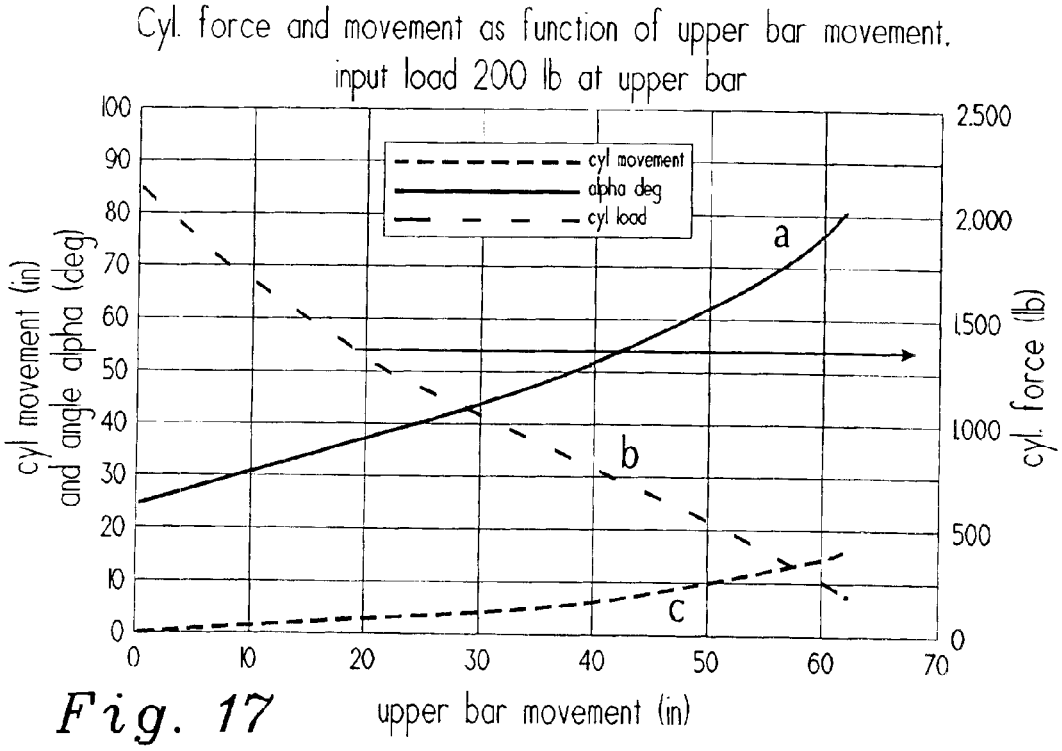
Figure 18:
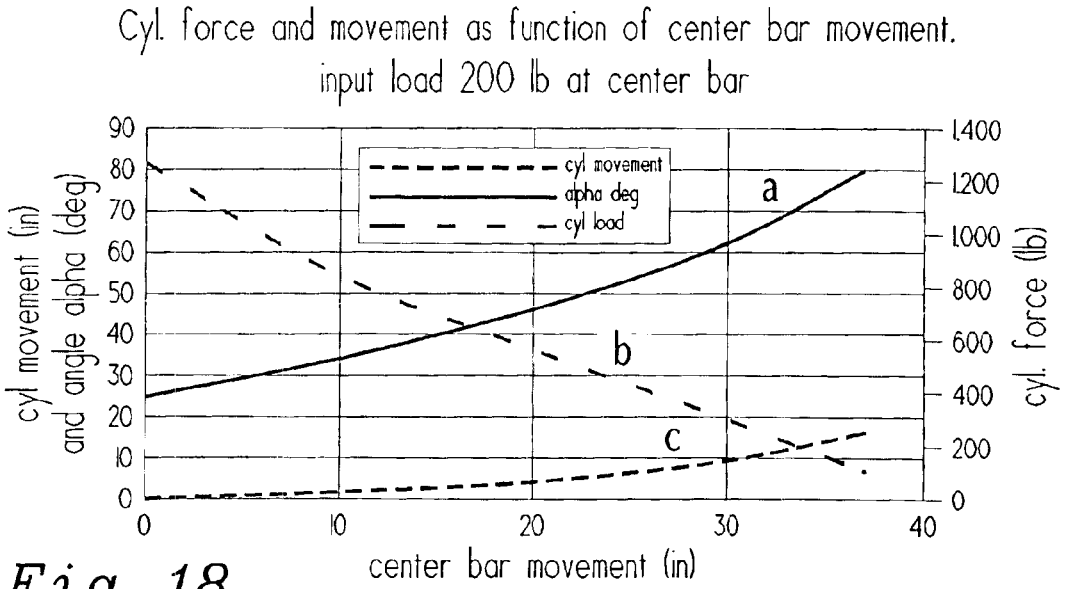
Figure 19:
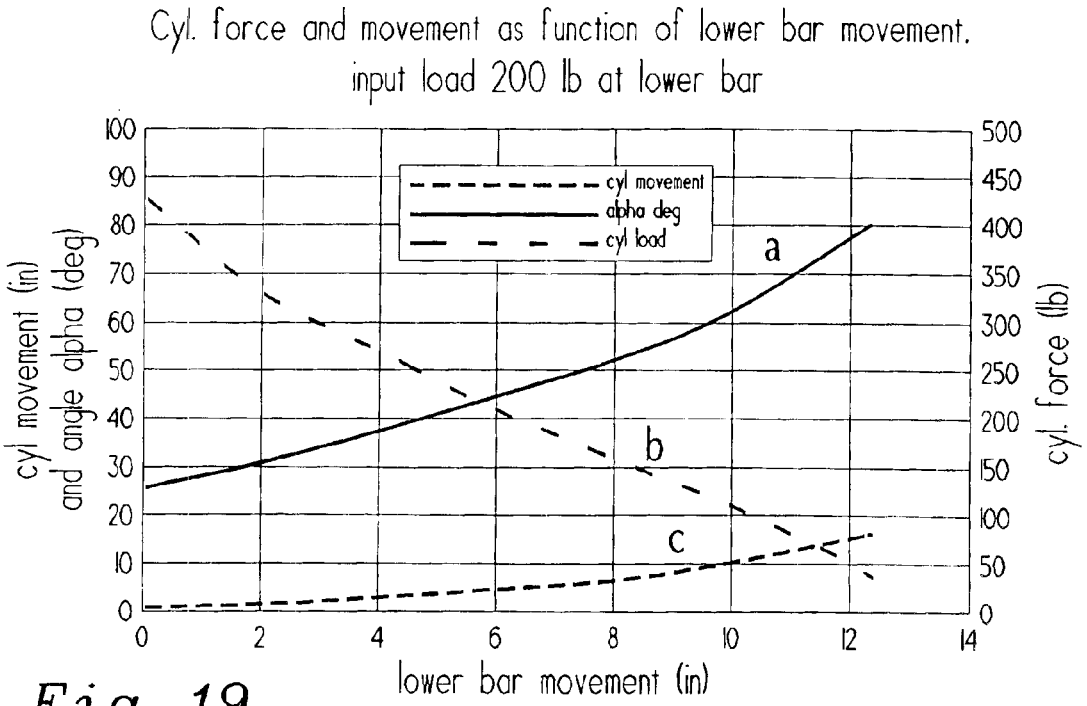

This counter force can be controlled as shown in FIG. 4. The control valve (490) controls the area through which the hydraulic liquid is pressed. The smaller the area, the higher the resistance and the larger the force against the athlete's movements. An advantage is that the force setting for both strokes (up/down or forward/back or any combination) can be different, and the force setting also can be changed during the stroke itself. Using the apparatus shown in FIGS. 5 and 6, this change can be preprogrammed in the following ways:

The counter force may be programmed as a function of the waypoint of the exercise bar (150). The control valve (490) can be programmed so that the force that the athlete encounters varies with his movements. This situation is shown in FIGS. 17, 18 and 19, discussed below.

A second control method programs the control valve (490) so that the athlete feels a variation of counter force during the movement of the exercise bar (150), depending on way point or location of the bar. This may be used, for example, if the athlete wants to start the first part of the exercise with a low counter force and then increase the load. Such typical load profile can be seen in FIG. 13, discussed below.

The load control programming may vary the counter force as a function of movement speed. The resulting graphs of load (trace a) and displacement (trace b) over time can be seen in FIG. 14 discussed below. In the example given, the speed is constant because the displacement is a linear function of time. Feedback is arranged so that the load control system increases or decreases the reaction force as speed increases or decreases.

Figure 15:
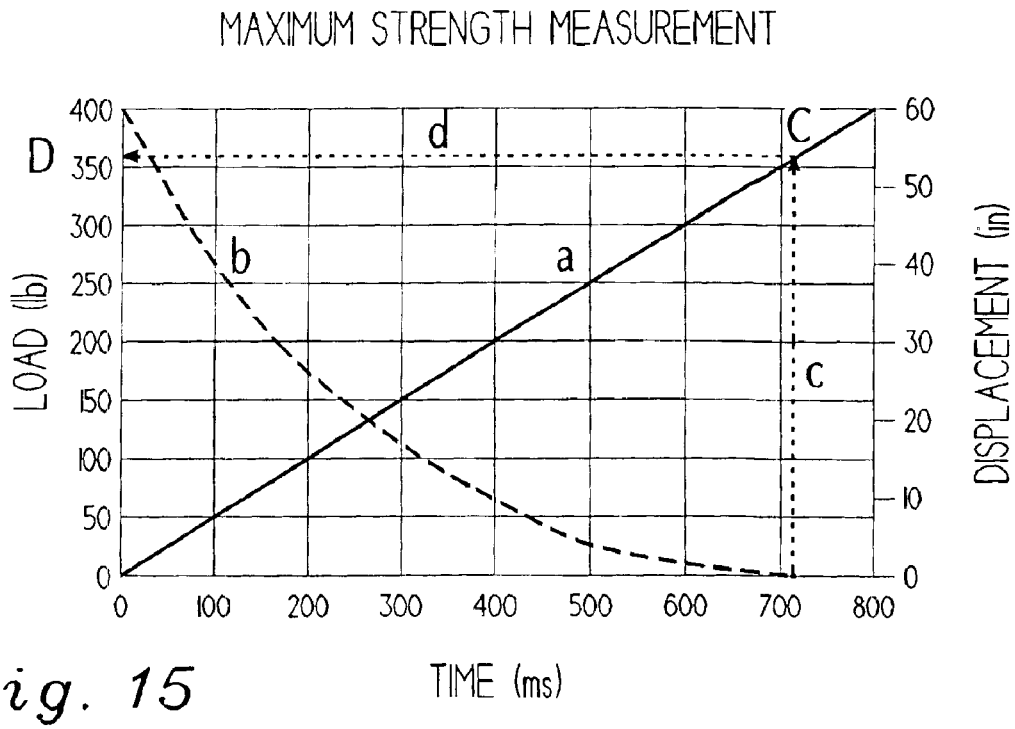

FIG. 15 illustrates another possible passive load control method. This control curve setup is suitable to measure (and allow exercise for) maximum strength. The load (trace a) rises linearly with time until the movement of the athlete comes to a stop; in the example shown at 710 milliseconds. It is the time where the curve of the displacement (trace b) reaches the x-axis; that is, when the athlete's movement comes to a stop. From this point a line can be drawn to the load curve (trace a). The load value at the intersection C gives the readout for the maximum strength of the athlete in this exercise.

Displacement d correlates to velocity by dividing through time t ($v=d/t$) and acceleration a by dividing again through the time ($a=v/t$).

When we multiply the mass (m) by velocity we will get the momentum ($M=m*v$). And when we multiply the mass (m) by the acceleration (a) we get the force ($F=m*a$). For rotational movements the moment is important, which is leverage times force. The stress on a system can be expressed by "pressure" or force F per area A ($s=F/A$).

Figure 21:
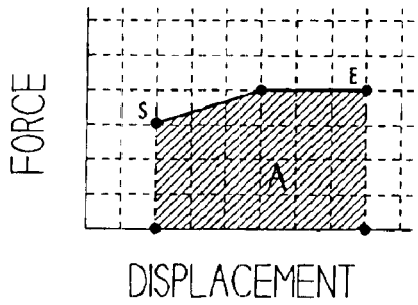
Figure 22:
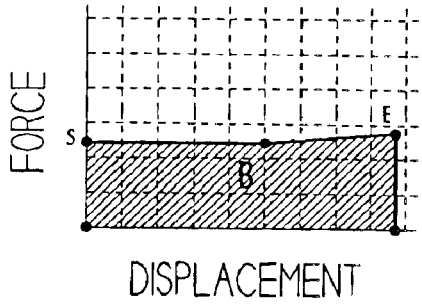

It is important to recognize these measurements can be reproduced. The proof is that the power P, defined as work times displacement ($W=F*d$) divided by time ($P=W/t$), is always the same when the area under the force-displacement curve is the same. It does not matter how high the load is set for one individual. At a higher load setting the displacement per time will be smaller as can be seen in FIG. 21 and at a lower force setting the displacement will be larger FIG. 22. However, the areas "A" (FIG. 21) and "B" (FIG. 22) will be the same for this individual athlete providing he has the same state of conditioning at times when the measurements are taken. Work represents the energy expended by the athlete and this value may be of interest to trainers as well.

The values thus computed are compared with the preselected program values and the differential signal thus computed is used to control the flow rate in the control valve (505) that interconnects both chambers of the load control cylinder (510). If the control valve (505) opens more, then the piston in the load control cylinder (510) can be moved more freely and the athlete will feel a low or even no counter force.

The movement of the athlete can be measured continuously and the counter load can be changed immediately in both directions. The exercise bar (150) can be a simulated weight for weight training or a pull bar that opposes the athlete's pulling force.

In the preferred method all measured values will be recorded, including time, displacement, and the pressures in the hydraulic cylinders. The pressure measurements enable the calculation of the force. The measurement of displacement over time allows calculation of the speed of movement and acceleration. Conventional pressure transducers may be used. Preferably the values thus obtained are recorded on the disk storage in the computer (600), or, they may be transmitted in real time to other recording devices or printed on paper.

The Active Load Control Loop

Figure 6:
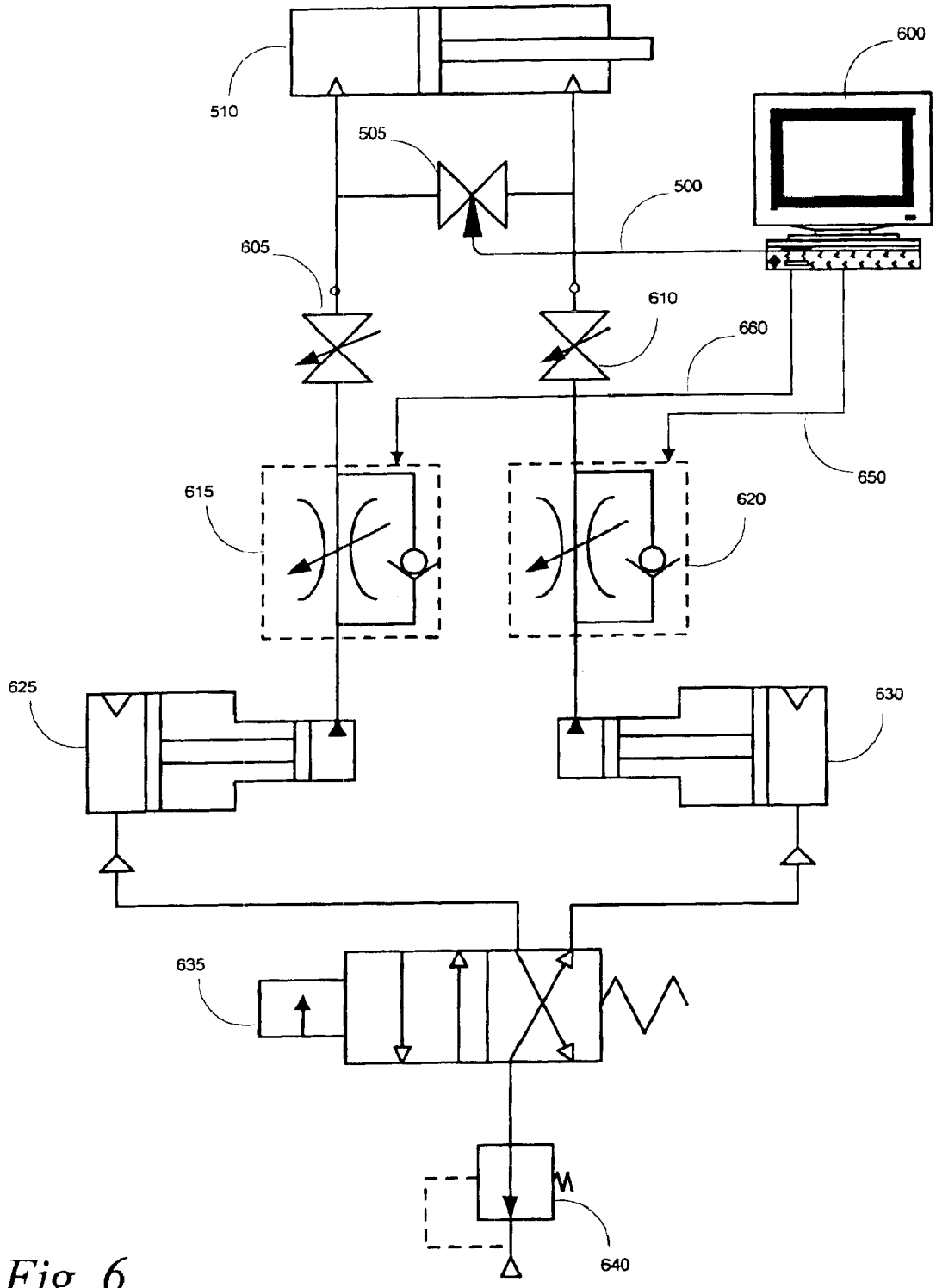
FIG. 6 is a schematic view of the fluid control system for an embodiment of the invention supporting both passive and active load control.

The active load control apparatus, depicted in FIG. 6, uses the main control loop just described. The difference is that the opening and closing of a top counter-force valve (615) and a bottom counter-force valve (620) is controlled instead of one load control valve per cylinder (505, 545).

Points A–B and C–D on the hydraulic lines to the load control hydraulic cylinders (510, 555) may be further connected as described next, to an active load control system. An active control system not only generates a certain resistance to the athlete's movements, but also inserts a counter-force to the force imposed by the athlete on the exercise bar (150).

FIG. 6 shows an embodiment of the invention with the addition of active control. For illustration, only the first load control hydraulic cylinder (510) is shown in FIG. 6. The same components would be connected in a similar way for the second load control hydraulic cylinder (555) in each cylinder pair. In this illustration, the system is partly pneumatic and partly hydraulic. It is generally cheaper and more convenient to operate the additional valves shown in FIG. 6 pneumatically, while reserving the hydraulic system to the load control hydraulic cylinders (510, 555). However, we have found a purely pneumatic system to give the best performance. In this case, the hydraulic valves and actuators would be replace by pneumatic valves and actuators of similar specifications.

In FIG. 6, the first load control valve (505) is connected across the top and bottom reservoirs of the first load control hydraulic cylinder (510), as shown in FIG. 5. However, in the active load control system, the load control valves (505, 545) are held closed. The first electrical line (500) connects to a switch interface controlled by the computer (600). FIG. 6 omits the pressure transducers (515, 520) for clarity, but, as just explained, they are connected to the data-collection device (560) connected to the computer (600). Now, however, the hydraulic lines leaving the top and bottom reservoirs of the hydraulic cylinder (510) are connected at points A and B to a top counter-force control valve (615) and a bottom counter-force control valve (620). This connection is made through a top shut-off valve (605) and a bottom shut-off valve (610). If the shut-off valves (605, 610) are closed, then the system is removed from active control. The top and bottom counter-force valves (615, 620) receive control signals from the computer (600) by means of electrical connections (650, 660) as shown. Since the load control valves (505, 545) are shut, the differential pressure in the first and second load control hydraulic cylinders is entirely controlled by the counter-force valves (615, 620).

A top pneumatic-to-hydraulic transformer valve (625) and a bottom pneumatic-to-hydraulic transformer valve (630) convert the respective pneumatic pressures to hydraulic pressures. The pneumatic side of each transformer valves (625, 630) is connected to a position-limit control valve (635). In operation, compressed air of variable pressure, depending upon the predetermined maximum magnitude of the counter force moves the piston of the transformer valve (625, 630) which transforms the pneumatic system into a hydraulic system. The position-limit control valve (635) is operated through the position limits of the exercise bar (150). For example, the position switches at the lower limit position to upward direction and at the upper limit to downward moving direction. The position-limit valve (635) is pre-set to the maximum value of the counter force. Thus the counter force can vary as a function of displacement of the exercise bar (150), its speed, or its acceleration.

We reference FIG. 6 as our example of a load control cylinder (510) in a typical pair of load control means (180, 190). As shown in FIG. 8, the program starts with power on in step 800. The displacement ("D" in the figures) is first set for neutral balance in step 805. At step 810, the control valves (505, 540) open slightly by a pre-determined amount. Step 815 checks the beam displacement to determine if the displacement is stable; that is, not changing. If the displacement is not stable, a check is made at step 820 to determine if the displacement is rising or falling. If falling, control returns to step 810 to open the control valves more. If rising, the control valves (505, 545) are gradually closed by a pre-determined amount in step 825. When displacement is stable, the system next sets the value of the maximum counter force beginning in step 830. At step 835 the program opens the counter force control valves (615, 620) gradually a predetermined amount. (The counter force valves are labeled "CF" in the figures). Execution continues to point "B" on FIG. 9. A check is made at step 840 to determine if the displacement is stable. If the displacement is not stable, the loop of steps 845, 850, 855, and 860 set the counter force valve until displacement is stable, as described in the previous paragraph. At step 865 we are ready to start the exercise. Execution continues to point "C" on FIG. 10.

The next steps assume the athlete is applying an upward force to the exercise bar (150) and that the counter force is set to be constant. The same control loop applies of course, to other exercises, as determined by the control settings previously described. At step 870 the athlete applies an upward load. Step 875 checks the cylinder pressure to see if the pressure is increasing as the athlete exerts force. If it is, then the counter force valve (615, 620) is opened gradually at step 885 to increase the pressure, and thus the counter force, and control precedes to step 900. If not, step 880 checks to see if the displacement is increasing. Step 900 checks to see if the load control valves (505, 545) are set to their pre-set pressure. If not, control returns to decision step 880. If the displacement is increasing, control transfers to step 885 to open the counter force valve (615, 620). If displacement is not increasing, control transfers to step 890 to gradually close the control valves (505, 545) to decrease the pressure. If the control valves are at their preset pressure, control transfers to step 910, so that the exercise may continue.

Safety Routine

Figure 11:
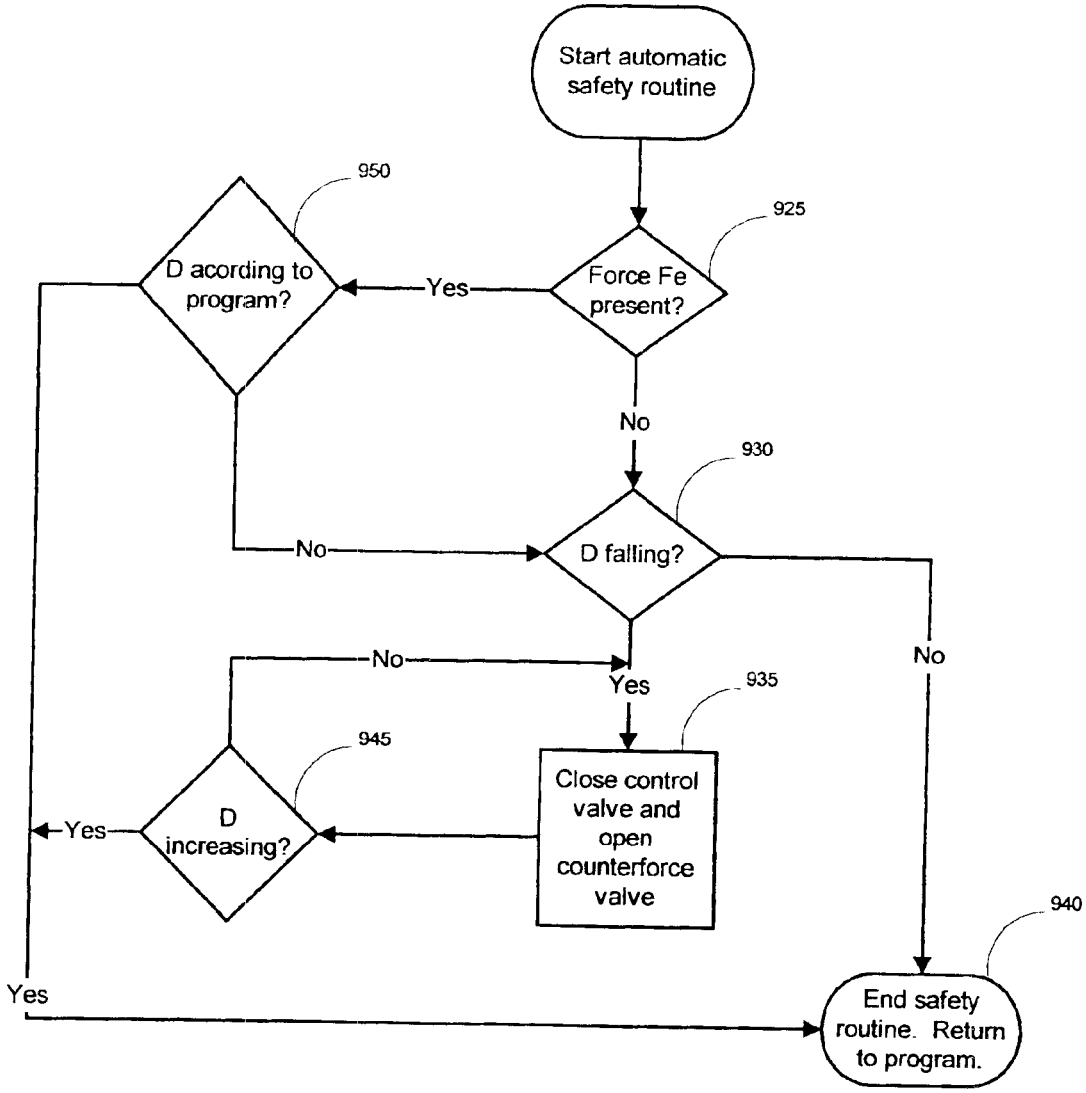
FIG. 11 is a flow chart showing the automatic safety routine of the preferred embodiment.

FIG. 11 illustrates the flow of control in an automatic safety routine. This routine is always activated and checks for the presence of the external force (Fe) acting on the beams. If this force is not present then the safety routine begins. Step 930 checks to see if displacement is falling. If not, the safety routine can exit and control returns to the main program. If the displacement is falling, the exercise bar (150) may be moving downward faster than planned and the athlete may be injured unless movement of the exercise bar is stabilized. If the check in step 925 determines the external force Fe imposed by the athlete is present, step 950 checks to see if the displacement is according to the control program setup. If is, control is transferred to step 940 so that the exercise may continue. If the displacement is not according to the program, then control is transferred to step 925 to determine if the displacement is falling. If the displacement is falling, step 935 closes the control valves (505, 545) and opens the counter force valve (615, 620). Step 945 checks that displacement is now increasing. If it is, control transfers to step 950. If not, control returns to step 935 to again close the control valves (505, 545) and open the counter force valves (615, 620).

Load Control Illustrations

Figure 12:
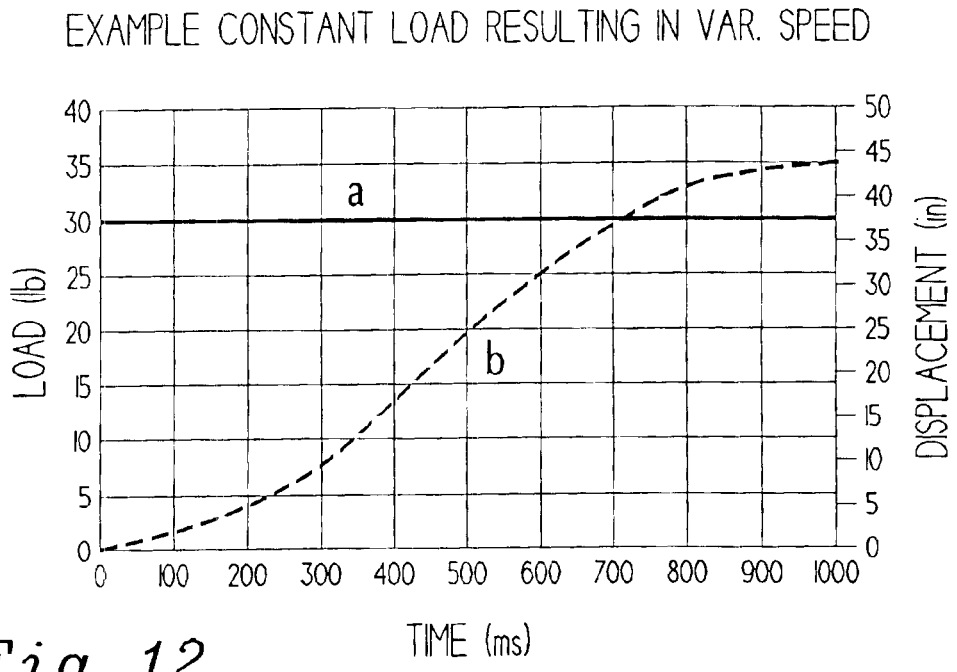
FIGS. 12 through 22 are graphs depicting the behavior of various parameters during operation of the preferred embodiment.

FIG. 12 shows the standard passive load control curve. The load on the system is controlled so the athlete feels over the full range of his movement the constant load (trace a), in this example 30 lb This type of load setting can never lead to an accident in which the bar falls down onto the athlete. Trace a depicts the load felt by the athlete. If the control force is varied in this way, the athlete will have the feeling of moving a set of barbells (whose weight does not change), shown as straight line (trace a) in FIG. 13. The S-shaped curve from the lower left to the upper right (trace b) represents the resulting displacement of the exercise bar over the time of the exercise stroke. The athlete will tend to move the exercise bar slowly at first, the faster, then slowly at the end of the stroke.

Figure 13:
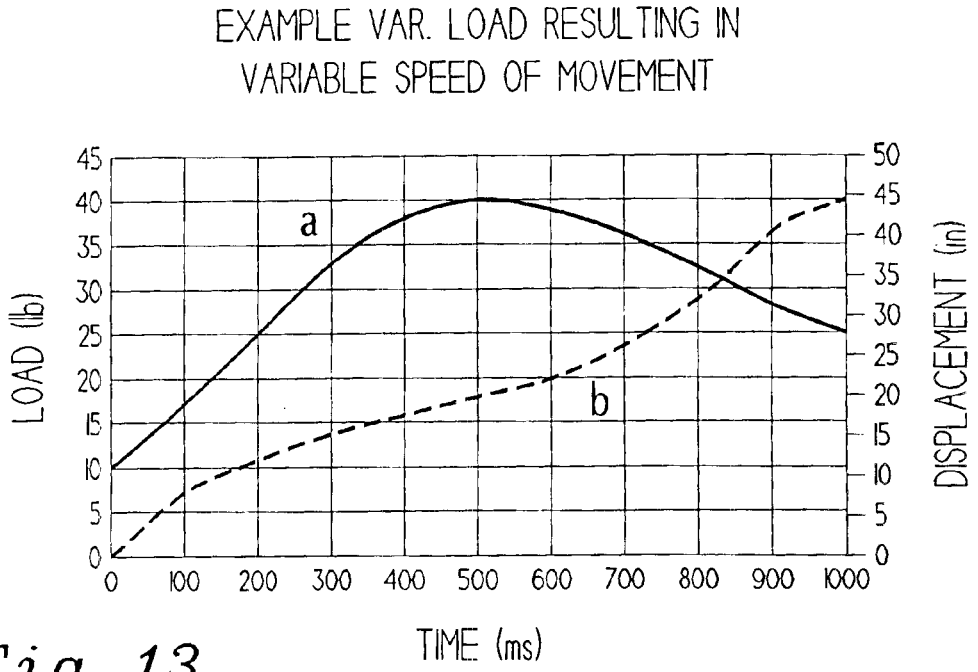

FIG. 13 is the control curve that most commonly will be used. The athlete will program a load profile (trace a) and the resulting displacement will be a curve (trace b) that results from the force he has to counteract and his body position; for example, like bending of his elbows when he exercises weight lifting.

Figure 14:
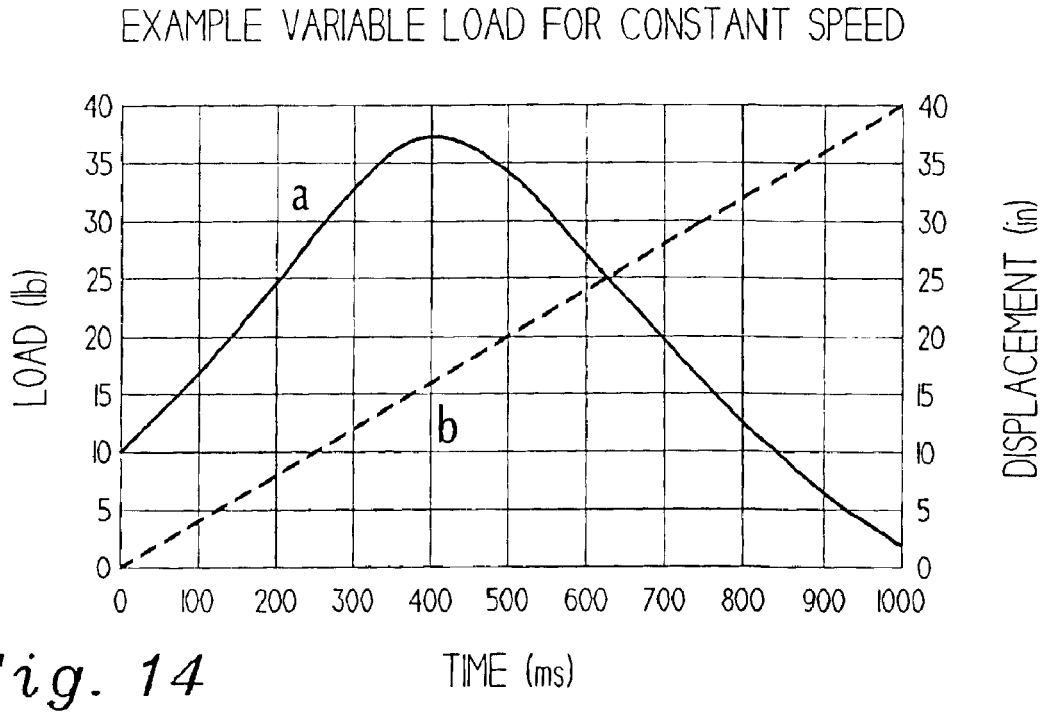

FIG. 14 is an automatically generated control curve. The load setting (trace a) is automatically adjusted so that a uniform, constant speed or linear displacement curve (trace b) results. This set-up allows measurement of strength as a function of the bending angle of the athlete's limbs.

FIG. 15 shows one more application. It is the measurement of the maximum strength. The load control program drives the force on the bar constantly up (the curve may be linear or exponential) until the athlete cannot push or pull the bar, and his movement comes to a stop (trace b). In the example, this is the case after about 710 ms. Looking at the control curve (trace a) where the 710 millisecond line crosses (point C) this correlates to a counter force of 370 lb (1645.8 Newtons) (point D).

The following figures show the resulting forces based upon input load from the athlete, location of the load mechanisms, location of the exercise bar and the position of the exercise bar (150).

Trace e in FIG. 16 pictures the cylinder load (horizontal, bottom, center to top) as function of bar setting and displacement. The bar setting and displacement is represented implicitly by the angle α, (trace a) at an input force of 200 lb (889.6 Newtons) at the center exercise bar (150) position P2, shown in FIG. 2C. A low position exercise bar (150) input load of 200 lb at a of 25 degrees results in a control cylinder load of about 1,200 lb (5337.8 Newtons). After the bar has moved 76 cm (30 in) upward, the load on the control cylinder will be about 300 lb (1334 Newtons). The explanation is that the leverage decreases with increasing upward displacement. Trace b shows the displacement of the upper bar position at P3, and trace c shows the displacement of the lower bar position P1 during this maneuver.

FIGS. 17, 18, and 19 show the load on the horizontal control cylinder as function of the load input, the upper (FIG. 17), center (FIG. 18) and lower (FIG. 19) exercise bar (150) positions. These depict graphs of cylinder force, cylinder movement, and bar movement. (Assuming now, for illustration, that the actuators for the load control means (180, 190) are hydraulic cylinders). FIGS. 17, 18, and 19 differ in the point where the exercise bar (150) is attached to the pantograph truss (100). Looking at FIG. 17 one can see the change in the load cylinder based upon the displacement of the upper bar at a constant push or pulling force of 200 lb (889.6 Newtons). The control valves (504, 545) have to be changed in correlation to the movement. The variation of the control force to accomplish this is shown in FIG. 14, discussed above.

The explanation why the force acting on the cylinder, 600 to 2000 lb (2269 to 8896 Newtons) is so much higher than the input force can be seen in the lowest curve of the graph in FIG. 17 (trace c). This curve shows the movement of the horizontal control cylinders. When the exercise bar moves 50 inches (127.7 cm) the control cylinder's piston will move only 10 inches (25.4 cm).

The remaining curve (trace a) in FIG. 17 shows the change in the angle α. This angle was defined above in the calculation of the beam travel. It is measured by a transducer (300) suitably connected to a pivot (200, 220) on the pantograph truss (100), as described above.

FIG. 20 shows the correlation of the input load and the load on the vertical load control means (180).

In the preferred embodiment, the computer (600) is programmed to accept inputs that determine the parameters of the control program. Preferably, this is done through 11 display screens or control panels which present options to a user. The user inputs are input to the program running on the computer (600). Typical control panel inputs are shown in the following set of figures.

The first screen, FIG. 23, shows typical exercises or measurements that can be performed. The example "flexibility" is selected in this first setup screen.

The next screen, FIG. 24, is used to select the basic load program. The example shows "variable load" over displacement of the exercise bar (150).

In the following three screens, FIGS. 25, 26, and 27, the load program is more detailed for the main three cases: constant load over displacement, variable load over displacement with several setups, and variable load over the speed by which the exercise bar (150) is moved.

The next display, FIG. 28, shows the setup for the position of the exercise bar (150). The position can be entered manually or it could be setup that the apparatus detects the position automatically.

Since those skilled in the art can modify the specific embodiments described above, we intend that the claims be interpreted to cover such modifications and equivalents.

We claim:

1. A method of providing load control for an exercise apparatus, the apparatus comprising an exercise bar, a means for measuring the displacement over time of the exercise bar, horizontal and vertical actuators connected to move the exercise bar, a computer for generating horizontal and vertical actuator signals operatively connected to the means for measuring the displacement of the horizontal and vertical actuators and the computer; the method comprising:

programming the computer to generate actuator signals for a predetermined exercise activity;

generating displacement signals from the means for measuring the displacement over time of the exercise bar;

transmitting the displacement signals to the computer;

calculating, in the computer, the speed and acceleration of the exercise bar;

calculating, in the computer, one or more actuator signals sufficient to maintain the speed, displacement, or force parameters for the predetermined exercise activity; and, transmitting the actuator signal to the actuators, so that the actuators move the exercise bar according to the predetermined exercise activity.

2. The method of claim 1 where the step of calculating, in the computer, one or more actuator signals sufficient to maintain the speed, displacement, or force parameters for the predetermined exercise activity, further comprises calculating a force parameter that varies linearly as a function of the displacement of the exercise bar.

3. The method of claim 1 where the step of calculating, in the computer, one or more actuator signals sufficient to maintain the speed, displacement, or force parameters for the predetermined exercise activity, further comprises calculating a force parameter that varies non-linearly as a function of the displacement of the exercise bar.

4. The method of claim 1 where the step of calculating, in the computer, one or more actuator signals sufficient to maintain the speed, displacement, or force parameters for the predetermined exercise activity, further comprises calculating a force parameter that varies as a function of the speed of the exercise bar.

5. The method of claim 1 where the step of calculating, in the computer, one or more actuator signals sufficient to maintain the speed, displacement, or force parameters for the predetermined exercise activity, further comprises calculating a force parameter that varies as a function of time.

6. The method of claim 1 further comprising the step of recording the values of calculated and actual parameters of speed, displacement or force for a particular exercise.

7. The method of claim 1, further including a safety routine, the safety routine comprising the steps of:

checking for the presence of an external force acting on the exercise bar; and, if no external force exists, checking to see if the displacement of the exercise bar is falling, and if so;

computing an actuator signal to increase the displacement of the exercise bar.

8. A method of providing load control for an exercise apparatus, the apparatus comprising an exercise bar, a means for measuring the displacement over time of the exercise bar, horizontal and vertical actuators connected to move the exercise bar, a computer for generating horizontal and vertical actuator signals operatively connected to the means for measuring the displacement of the horizontal and vertical actuators and the computer; and counter-force valves connected across at least one of the horizontal and vertical actuators; the method comprising:

programming the computer to generate actuator signals for a predetermined exercise activity;

generating displacement signals from the means for measuring the displacement over time of the exercise bar;

transmitting the displacement signals to the computer;

calculating, in the computer, the speed and acceleration of the exercise bar;

calculating, in the computer, one or more actuator signals sufficient to maintain the speed, displacement, or force parameters for the predetermined exercise activity; and, transmitting the actuator signal to the counter-force valves, so that the actuators are commanded to move the exercise bar according to the predetermined exercise activity.

9. The method of claim 8 where the step of calculating, in the computer, one or more actuator signals sufficient to maintain the speed, displacement, or force parameters for the predetermined exercise activity, further comprises calculating a force parameter that varies linearly as a function of the displacement of the exercise bar.

10. The method of claim 8 where the step of calculating, in the computer, one or more actuator signals sufficient to maintain the speed, displacement, or force parameters for the predetermined exercise activity, further comprises calculating a force parameter that varies non-linearly as a function of the displacement of the exercise bar.

11. The method of claim 8 where the step of calculating, in the computer, one or more actuator signals sufficient to maintain the speed, displacement, or force parameters for the predetermined exercise activity, further comprises calculating a force parameter that varies as a function of the speed of the exercise bar.

12. The method of claim 8 where the step of calculating, in the computer, one or more actuator signals sufficient to maintain the speed, displacement, or force parameters for the predetermined exercise activity, further comprises calculating a force parameter that varies as a function of time.

13. The method of claim 8 further comprising the step of recording the values of calculated and actual parameters of speed, displacement or force for a particular exercise.

14. The method of claim 8, further including a safety routine, the safety routine comprising the steps of:

checking for the presence of an external force acting on the exercise bar; and, if no external force exists, checking to see if the displacement of the exercise bar is falling, and if so;

computing an actuator signal to increase the displacement of the exercise bar.

15. A method of providing load control for an exercise apparatus, the apparatus comprising an exercise bar moveably connected between congruent pantograph trusses, a means for measuring the displacement over time of the exercise bar, horizontal and vertical actuators connected to move the exercise bar, a computer for generating horizontal and vertical actuator signals operatively connected to the means for measuring the displacement of the horizontal and vertical actuators and the computer; the method comprising:

programming the computer to generate actuator signals for a predetermined exercise activity;

generating displacement signals from the means for measuring the displacement over time of the exercise bar;

transmitting the displacement signals to the computer;

calculating, in the computer, the speed and acceleration of the exercise bar;

calculating, in the computer, one or more actuator signals sufficient to maintain the speed, displacement, or force parameters for the predetermined exercise activity; and, transmitting the actuator signal to the actuators, so that the actuators move the exercise bar according to the predetermined exercise activity.

16. The method of claim 15 where the step of calculating, in the computer, one or more actuator signals sufficient to maintain the speed, displacement, or force parameters for the predetermined exercise activity, further comprises calculating a force parameter that varies linearly as a function of the displacement of the exercise bar.

17. The method of claim 15 where the step of calculating, in the computer, one or more actuator signals sufficient to maintain the speed, displacement, or force parameters for the predetermined exercise activity, further comprises calculating a force parameter that varies non-linearly as a function of the displacement of the exercise bar.

18. The method of claim 15 where the step of calculating, in the computer, one or more actuator signals sufficient to maintain the speed, displacement, or force parameters for the predetermined exercise activity, further comprises calculating a force parameter that varies as a function of the speed of the exercise bar.

19. The method of claim 15 where the step of calculating, in the computer, one or more actuator signals sufficient to maintain the speed, displacement, or force parameters for the predetermined exercise activity, further comprises calculating a force parameter that varies as a function of time.

20. The method of claim 15 further comprising the step of recording the values of calculated and actual parameters of speed, displacement or force for a particular exercise.

21. The method of claim 15, further including a safety routine, the safety routine comprising the steps of:

checking for the presence of an external force acting on the exercise bar; and, if no external force exists, checking to see if the displacement of the exercise bar is falling, and if so;

computing an actuator signal to increase the displacement of the exercise bar.

* * * * *